US006070411A

United States Patent [19]

Iwai et al.

[11] Patent Number: 6,070,411

[45] Date of Patent: Jun. 6, 2000

[54] GAS TURBINE COMBUSTOR WITH PREMIXING AND DIFFUSING FUEL NOZZLES

[75] Inventors: Yasunori Iwai; Hiroaki Okamoto, both of Yokohama; Fukuo Maeda, Machida; Masao Itoh, Yokohama, all of Japan

[73] Assignee: Kabushiki Kaisha Toshiba, Kawasaki, Japan

[21] Appl. No.: 08/977,671

[22] Filed: Nov. 24, 1997

[30] Foreign Application Priority Data

Nov. 29, 1996 [JP] Japan ..... 8-320409

[51] Int. Cl.[7] ..... F23R 3/20

[52] U.S. Cl. ..... 60/737; 60/746

[58] Field of Search ..... 60/39.02, 39.06, 60/737, 746, 747

[56] References Cited

U.S. PATENT DOCUMENTS 5,062,762 11/1991 Maghon ..... 60/747
5,660,045 8/1997 Ito et al. ..... 60/747
5,729,968 3/1998 Cohen et al. ..... 60/746
5,802,854 9/1998 Maeda et al. ..... 60/746

*Primary Examiner*—Louis J. Casaregola
*Attorney, Agent, or Firm*—Oblon, Spivak, McClelland, Maier & Neustadt, P.C.

[57] ABSTRACT

A gas turbine combustor comprises: an outer casing; a combustor inner cylinder disposed inside the outer casing; a combustion chamber formed in the combustor inner cylinder; a pilot fuel injection unit disposed to a head side portion of the combustion chamber, the pilot fuel injection unit comprising a first premixing combustion nozzle unit, a diffusing combustion nozzle unit and a second premixing combustion nozzle unit, the first premixing combustion nozzle unit being arranged at a central portion of the head side portion of the combustion chamber, the diffusing combustion nozzle unit being arranged so as to coaxially surround an outside of the first premixing combustion nozzle unit and the second premixing combustion nozzle unit being arranged so as to coaxially surround an outside of the diffusing combustion nozzle unit, respectively; and a premixing combustion chamber disposed to an outlet side of the first premixing combustion nozzle unit so as to be communicated with the combustion chamber. There may be further disposed a main premixing fuel injection unit to an outside of the second premixing combustion nozzle unit.

18 Claims, 20 Drawing Sheets

GAS TURBINE COMBUSTOR WITH PREMIXING AND DIFFUSING FUEL NOZZLES

BACKGROUND OF THE INVENTION

The present invention relates to a gas turbine combustor for combusting premixed fuel in a fuel lean state which is obtained by adding air to fuel and an operating method thereof, and more specifically, to a gas turbine combustor capable of effectively lowering concentration of NOx contained in the exhaust gas from a gas turbine and an operating method thereof.

In general, a gas turbine power generation plant has a plurality of gas turbine combustors interposed between an air compressor and a gas turbine and creates a combustion gas by the gas turbine combustors by adding a fuel to a compressed air guided from the air compressor. The combustion gas is guided into the gas turbine and an expansion work is executed and a generator is driven by making use of the rotational torque obtained by the expansion work.

Incidentally, recent gas turbine power generation plants are required to increase a generated power in addition to the increase of a fuel efficiency and, for this purpose, the combustion gas temperature at a gas turbine inlet is increased so as to increase the power of the gas turbine by increasing the temperature of the combustion gas created by the gas turbine combustor.

However, various restrictions are imposed on the gas turbine combustor by the increase of the combustion gas temperature at the gas turbine inlet and one of them is an environment problem relating to a NOx concentration.

The NOx concentration directly depends on the temperature increase of the combustion gas, and as the temperature of the combustion gas is more increased, the concentration thereof is more increased. That is, when the combustion gas is created by the mixture of fuel and air, as an equivalent ratio (ratio of a fuel flow rate to an air flow rate) approaches a value of 1, the temperature of the combustion gas is more increased and the nitrogen contained in the air is bonded to a larger amount of oxygen by the action of the reaction heat resulting from the temperature increase to thereby increase the NOx concentration.

There is available a lean premixing combustion system in the gas turbine combustor as a method of lowering the generation of NOx which burns fuel in a fuel lean state by previously mixing air with the fuel. According to such combustion system, since the fuel itself has been already made to the lean state, when a combustion gas is created, the peak temperature of the combustion gas can be suppressed as compared with a conventional diffusing combustion system and a NOx reduction ratio of about 20% can be ordinarily achieved.

However, as shown in FIG. 19, it is difficult for the lean premixing combustion system to control the equivalent ratio when the combustion gas is created. When the equivalent ratio is low, a combustion efficiency is lowered and the generation of uncombusted components such as CO, UHC (uncombusted hydrocarbon) etc. is increased, and sometimes, a flame blow out phenomenon rises, whereas when the equivalent ratio is high, the amount of NOx generated is abruptly increased. As a result, the range of combustion operation in which a low NOx state can be stably maintained for a long time is very narrow.

Recently, there have been proposed many combustion systems which use diffusing combustion and premixing combustion simultaneously as a technology which further develops the lean premixing combustion system, the systems being arranged such that a diffusing combustion zone is formed to the head portion of a combustion chamber, a premixing combustion zone is formed downstream side the diffusing combustion zone, a diffused combustion gas is created by charging the fuel into the diffusing combustion zone and a premixed combustion gas is created by charging the premixed fuel into the premixing combustion zone. One of the diffusing/premixing combustion systems is disclosed in Japanese Patent Laid-open Publication No. HEI 7-19482.

The prior art technology further reduces NOx by partially premixing pilot fuel for maintaining flame to thereby reduce diffused combustion by which a lot of NOx is generated, in addition to a matter that the main fuel for creating the combustion gas for driving the gas turbine is premixed.

As shown in FIG. 18, a gas turbine combustor according to the prior art technology is arranged such that a diffusing combustion zone 2 is formed to the head portion in a combustor inner cylinder 1, a premixing combustion zone 3 is formed downstream of the diffusing combustion zone 2, and a pilot fuel injection unit 6 for charging a pilot fuel A is disposed to the diffusing combustion zone 2 and a main fuel injection unit 16 for charging a main fuel C is disposed to the premixing combustion zone 3, respectively.

The pilot fuel injection unit 6 includes a diffusing combustion nozzle unit 4 at the center of the combustor inner cylinder 1 and a premixing combustion nozzle unit 5 to the outside of it.

The diffusing combustion nozzle unit 4 is partitioned into a first diffusing combustion nozzle unit 7 for charging a fuel al into the diffusing combustion zone 2 to maintain flame until a low load is imposed on the gas turbine and a second diffusing combustion nozzle unit 8 for charging a fuel a2 into the diffusing combustion zone 2 to maintain the flame in place of the first diffusing combustion nozzle unit 7 when an intermediate load is imposed on the gas turbine. Further, an air passage 9 is formed to the diffusing combustion nozzle unit 4 so as to concentrically surround the first and second diffusing combustion nozzle units 7 and 8, and a swirler 10 is disposed to the outlet end of the air passage 9 to thereby apply a swirling flow to the fuels al and a2 which are injected from the first and second diffusing combustion nozzle units 7, so that a circulating flow is formed in the diffusing combustion zone 2 to more securely maintain the flame.

The premixing/diffusing combustion nozzle unit 5 disposed outwardly of the diffusing combustion nozzle unit 4 is arranged such that when a fuel b which is used as a combustion gas for driving the gas turbine as well as a combustion gas for maintaining the flame is charged into the diffusing combustion zone 2 through a header 11, the nozzle unit 5 mixes the fuel b with the swirling air supplied from a swirler 12 in a premixing zone 13 and injects it into the diffusing combustion zone 2 as the premixed fuel in a lean fuel state and when the premixed fuel is injected, it is made to a circulating flow which is larger than the circulating flow in the first and second diffusing combustion nozzle units 7 and 8.

On the other hand, the main fuel injection unit 16 for charging a fuel c into the premixing combustion zone 3 is composed of a main fuel nozzle unit 14 and a premixing duct 15 and when the fuel c is injected from the main fuel nozzle unit 14 through a header 18, the main fuel injection unit 16 mixes the fuel c with the compressed air 17 from an air compressor, not shown, in the premixing duct 15 and injects the fuel c as a premixed fuel in a lean fuel state into the premixing combustion zone 3 to thereby create a combustion gas for driving the gas turbine using the combustion gas of the pilot fuel injection unit 6 as a pilot flame.

As shown in FIG. 19, a method of charging and distributing the fuel injected from the pilot fuel injection unit 6 into the diffusing combustion zone 2 and the fuel injected from the main fuel injection unit 16 into the premixing combustion zone 3 is performed in a manner such that while the load on the gas turbine, which is in start-up operation, is zero, the fuel al of the first diffusing combustion nozzle unit 7 is charged into the diffusing combustion zone 2. When the gas turbine is rotated 100% in a no load state, the fuel a2 of the second diffusing combustion nozzle unit 8 and the fuel b of the premixing/diffusing combustion nozzle unit 5 are simultaneously charged into the diffusing combustion zone 2. When the gas turbine is in an intermediate load state, the charge of the fuel al of the first diffusing combustion nozzle unit 7 is stopped and the fuel c of the main fuel injection unit 16 is charged into the premixing combustion zone 3 in place of it. When the load on the gas turbine is made to 100%, the ratio of the fuel c to the entire fuel flow rate is set to 70%–80%. Further, it is to be noted that the fuel a2 of the second diffusing combustion nozzle unit 8 at the time is as small as 2–5% which is set to the entire fuel flow rate and it is secured to maintain the flame.

As described above, the conventional gas turbine combustors suppress the generation of the NOx by partially premixing the fuel injected from the pilot fuel injection unit 6 into the diffusing combustion zone 2 as the flame maintaining combustion gas by paying attention to the diffusing combustion by which a large amount of the NOx is generated.

However, since the recent gas turbine power generation plants search for the power and thermal efficiency of the gas turbine which are higher than those achieved at present, a countermeasure for reducing the NOx is more required to cope with the increase of a combustion gas temperature. To maintain the NOx concentration which is lower than that regulated by the present law over the entire operating range from the low load operation to the 100% load operation of the gas turbine, it is required to develop a gas turbine combustor which further reduces the concentration of the NOx generated in the diffusing combustion.

Although the conventional gas turbine combustor shown in FIG. 18 partly executes the premixing of the pilot fuel injection unit 6, it is encountered with difficulty in the development of the premixing of the first diffusing combustion nozzle unit 7 and the second diffusing combustion nozzle unit 8. This is because that since the first diffusing combustion nozzle unit 7 and the second diffusing combustion nozzle unit 8 are provided to stably secure the combustion gas for the flame, when the premixing is executed to these units, there is caused a great factor by which the flame is blown out. When a diffused fuel is supplied into a single large combustion chamber in a small flow rate, a diffusing combustion zone is disturbed by the great disturbance of the premixing combustion zone 3 for the pilot premixed flame and the main premixed flame, by which the flames are made unstable and blown out.

It will be necessary to carry out a control such that when a load is shut off, the premixed fuel is shut off and the diffused fuel restricted to a small amount is increased accordingly. However, since the flow rate of the diffused fuel is not immediately increased due to the volume of a piping from a control valve to a diffusing nozzle injection valve, a premixed flame is misfired by the reduction of the premixed fuel before the flow rate of it increased, an amount of air being supplied increases instantaneously and the air/fuel ratio in the diffusing combustion unit is reduced. At the same time, the disturbance of a cold gas is caused also in the diffusing combustion unit by the misfire of the premixed flame and the diffused flame is blown out. As a result, when the diffused fuel is reduced to lower the NOx, blowing out is liable to be caused in ordinary operation as well as when the load is shut off.

Although a plurality of the gas turbine combustors, for example, eight sets are interposed between the air compressor and the gas turbine, an igniter is provided with one or two of them and the flame generated by the ignition of the igniter is sequentially propagated to the other gas turbine combustors. In this case, even if a combustion chamber is partitioned to a small size at the center of the gas turbine and fuel is supplied thereinto and ignited, only the center of the gas turbine is made to a high temperature by a resulting flame and the flame is not sufficiently propagated to a flame propagation pipe and thus the propagation thereof to the other gas turbine combustors is delayed.

SUMMARY OF THE INVENTION

A primary object of the present invention is to substantially eliminate defects or drawbacks encountered in the prior art mentioned above and to provide a gas turbine combustor and an operating method thereof which premix a fuel by minimizing the diffused combustion through which the NOx of a high concentration is generated and certainly secure a flame by the premixing so that the NOx is sufficiently reduced even if the temperature of a combustion gas is increased by the increase of the power of a gas turbine.

Another object of the present invention is to provide a gas turbine combustor and an operating method thereof capable of promptly propagating a flame to all the gas turbine combustors when fuel is ignited and securing the flame created from a pilot fuel injection unit only by premixing combustion by eliminating the diffusing combustion having a high NOx generation ratio when a 100% load is imposed or when a load is shut off.

These and other objects can be achieved according to the present invention by providing a gas turbine combustor comprising:

an outer cylinder;

a combustor inner cylinder disposed inside the outer cylinder;

a combustion chamber formed in the combustor inner cylinder;

a pilot fuel injection unit disposed to a head side portion of the combustion chamber, the pilot fuel injection unit comprising a first premixing combustion nozzle unit, a diffusing combustion nozzle unit and a second premixing combustion nozzle unit, the first premixing combustion nozzle unit being arranged at a central portion of the head side portion of the combustion chamber, the diffusing combustion nozzle unit being arranged so as to coaxially surround an outside of the first premixing combustion nozzle unit and the second premixing combustion nozzle unit being arranged so as to coaxially surround an outside of the diffusing combustion nozzle unit, respectively; and a premixing combustion chamber disposed to an outlet side of the first premixing combustion nozzle unit so as to be communicated with the combustion chamber.

In preferred embodiments of the present invention of the above aspect, a main premixing fuel injection unit may be further disposed to an outside of the second premixing combustion nozzle unit.

At least two sets of the pilot fuel injection units will be disposed to the head side portion of the combustion chamber, each of these pilot fuel injection units being composed of the first premixing combustion nozzle unit, the diffusing combustion nozzle unit and the second premixing combustion nozzle unit and being provided with the premixing combustion chamber disposed to the outlet side of the first premixing combustion nozzle unit.

The premixing combustion chamber disposed to the outlet side of the first premixing combustion nozzle unit is formed to provide either one of a concave shape and a conical shape. The premixing combustion chamber has a step-shaped cutout.

The premixing combustion chamber has injection holes communicated with a compressed air passage surrounding the premixing combustion chamber. The premixing combustion chamber has a wall surface which is composed of either one of ceramics and a ceramic-fiber-reinforced composite material. The premixing combustion chamber has projecting pieces formed integrally with the wall surface. The premixing combustion chamber is provided with a catalyst.

The diffusing combustion nozzle unit coaxially surrounding the outside of the first premixing combustion nozzle unit has a fuel injection hole arranged in a direction facing a flame propagation pipe disposed in the combustion chamber.

The first premixing combustion nozzle unit has a drive unit for moving a first fuel nozzle accommodated in a first premixing premixed gas passage formed to surround the first premixing combustion nozzle so as to permit it to freely advance and retract in an axial direction thereof. The drive unit is either one of a motor, a manual handle and a hydraulic mechanism.

According to another aspect of the present invention, there is provided a method of operating a gas turbine combustor for driving a gas turbine by a premixed flame created from at least one or more of a first premixing combustion nozzle unit, a second premixing combustion nozzle unit and a main fuel nozzle unit while the gas turbine is in rated load operation, the method comprising the steps of:

driving the gas turbine only by the premixed flame created from the first premixing combustion nozzle unit when a load of the gas turbine is shut off; and restarting, thereafter, the gas turbine by adding flames created from a diffusing combustion nozzle unit and the second premixing combustion nozzle unit.

According to the structures and characters of the present invention mentioned above, since the pilot fuel injection unit disposed to the head side portion (header) of the combustion chamber is composed of the first premixing combustion nozzle unit, the diffusing combustion nozzle unit and the second premixing combustion nozzle unit in the coaxial arrangement thereof on the header side, the first premixed flame created from the first premixing combustion nozzle unit can be stably combusted and the concentration of the NOx can be suppressed to the low level.

Since the diffusing combustion nozzle unit is disposed outwardly of the first premixing combustion nozzle unit in the gas turbine combustor, when the diffused flame created from the diffusing combustion nozzle unit is propagated to the other gas turbine combustors through the flame propagation pipe, it can be promptly and certainly propagated.

Since the temperature of the combustion gas as the flame is increased by combining the main premixing fuel injection unit with the pilot fuel injection unit, the power of the gas turbine can be increased.

Since the plurality of pilot fuel injection units may be disposed to the head side portion of the combustion chamber, the temperature distribution of the combustion gas as the flame in the combustion chamber can be made uniform and the occurrence of the vibration due to the combustion can be suppressed.

Since the cutout is formed to the premixing combustion chamber at the outlet of the first premixing combustion nozzle unit and suppresses the occurrence of the vibration due to the combustion by making use of the adhering force of the swirls generated by the cutout, the premixed flame can be stably secured.

Since the premixing combustion chamber is formed to the outlet of the first premixing combustion nozzle unit so as to provide the conical shape and the pressure of the premixed flame created in the premixing combustion chamber is restored, the staggering movement of the premixed flame can be surely prevented.

Since the injection holes are formed to the wall surface of the premixing combustion chamber at the outlet of the first premixing combustion nozzle unit and the wall surface is cooled by the compressed air from the compressed air passage, the wall surface can be prevented from being burnt by the premixed flame.

Since the wall surface of the premixing combustion chamber formed to the outlet of the first premixing combustion nozzle unit is formed of the ceramics or ceramics-fiber-reinforced composite material to cope with the high temperature, the generation of the uncombusted fuel can be reduced.

Since the drive unit is provided for the first fuel nozzle of the first premixing combustion nozzle unit and the volume of the premixing combustion chamber can be adjusted in correspondence to the operating states by advancing or retracting the first fuel nozzle in the axial direction by the drive force of the drive unit, the vibration due to the combustion generated on the basis of the increase or decrease of the fuels when the operating state changes can be suppressed.

Since the catalyst is provided for the combustion chamber formed to the outlet of the first premixing combustion nozzle unit, the combustible limit value of the premixed gas and the limit value at which no CO is generated can be lowered, whereby the concentration of generated NOx can be suppressed to the low level.

Furthermore, according to the operating method of the gas turbine combustor of the present invention the premixed flame created from the premixing combustion chamber of the first premixing combustion nozzle unit can be continuously secured even if the load on the gas turbine is shut off, so that the rated load operation can be restored more promptly than the conventional method by shortening the restating time of the gas turbine.

The nature and further characteristic features of the present invention will be made more clear from the following descriptions made with reference to the accompanying drawings.

DESCRIPTION OF THE PREFERRED EMBODIMENTS

Embodiments of a gas turbine combustor and an operating method thereof according to the present invention will be described hereunder with reference to the accompanying drawings.

Figure 1:
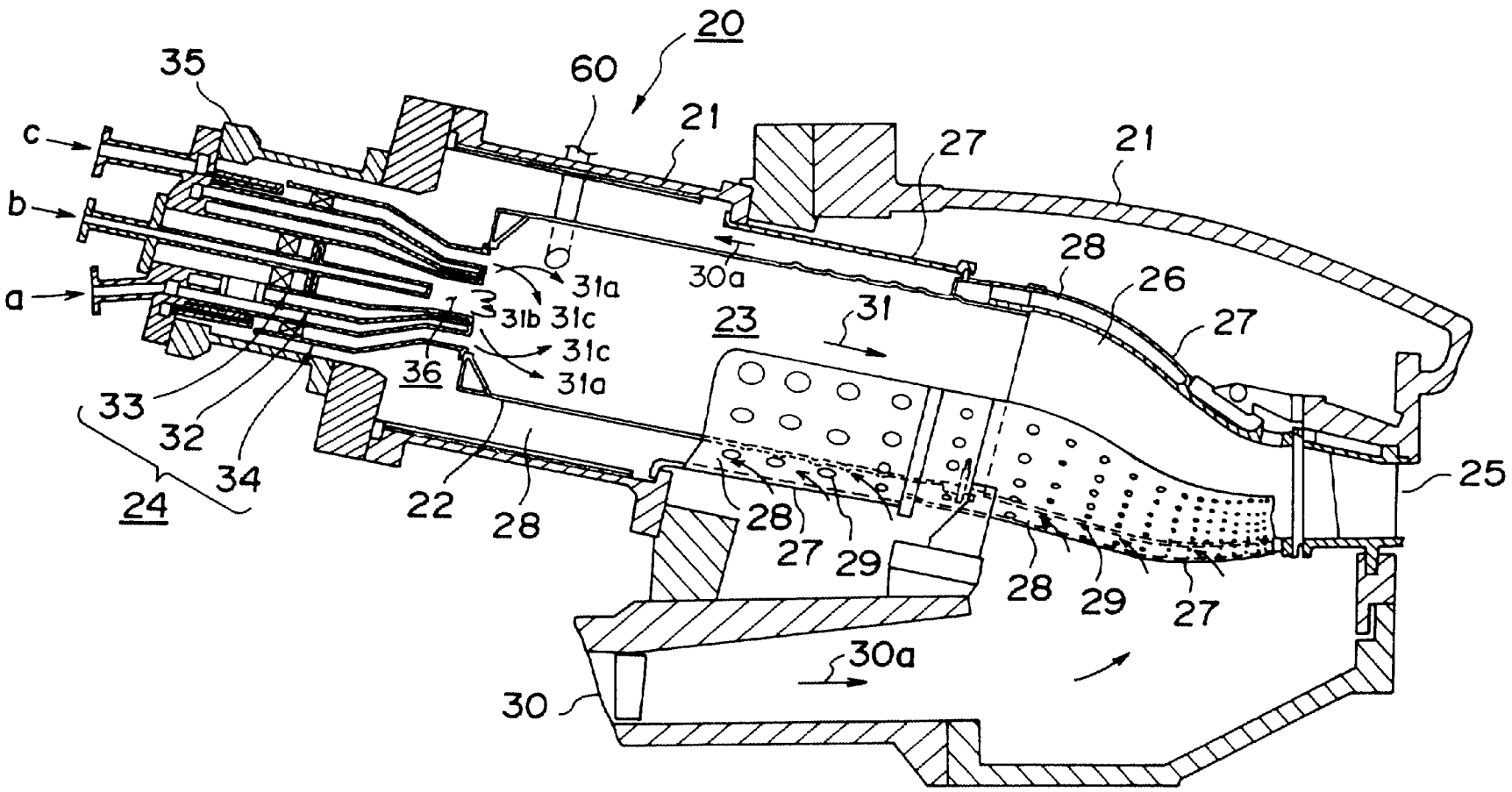
FIG. 1 is a schematic sectional view, partly cut away, showing a first embodiment of a gas turbine combustor according to the present invention.

FIG. 1 is a schematic sectional view, partly cut away, showing a first embodiment of a gas turbine combustor according to the present invention.

The gas turbine combustor whose entire arrangement is denoted by reference numeral 20 is formed to a multi-cylindrical structure having a combustor inner cylinder 22 surrounded by a combustor outer cylinder 21.

The combustor inner cylinder 22 extends in an axial direction and has a cylindrical combustion chamber 23 formed therein with a pilot fuel injection unit 24 disposed to the head portion thereof and a combustor tail cylinder 26 which communicates with a gas turbine blade 25 and is disposed downstream of the pilot fuel injection unit 24.

The combustor inner cylinder 22 and the combustor tail cylinder 26 are formed by being surrounded by a flow sleeve 27 around the outside thereof and an air passage 28 is formed by the flow sleeve 27.

The air passage 28 guides the compressed air 30*a* from an air compressor 30 through air holes 29 defined to the flow sleeve 27, the surfaces of the combustor inner cylinder 22 and the combustor tail cylinder 26 are cooled by a portion of the compressed air 30*a*, the temperature of a combustion gas 31 is diluted by another portion of the compressed air 30*a* and the rest of the compressed air 30*a* is guided to the pilot fuel injection unit 24.

The pilot fuel injection unit 24 is accommodated in a casing 35 and extends up to the head portion of the combustion chamber 23 in the axial direction. The pilot fuel injection unit 24 includes a first premixing combustion nozzle unit 33 disposed at the center of the casing 35, a diffusing combustion nozzle unit 32 formed by coaxially surrounding the first premixing combustion nozzle unit 33 and a second premixing combustion nozzle unit 34 formed by coaxially surrounding the diffusing combustion nozzle unit 32 and executes premixing by previously adding the compressed air 30*a* to the remaining fuels b, c which flow in the first premixing combustion nozzle unit 33 and the second premixing combustion nozzle unit 34 except the fuel a which flows in the diffusing combustion nozzle unit 32.

Further, the first premixing combustion nozzle unit 33 coaxially surrounded by the diffusing combustion nozzle unit 32 and the second premixing combustion nozzle unit 34 is provided with a premixing combustion chamber 36 whose outlet is formed to a concave shape.

In the pilot fuel injection unit 24 arranged as described above, when the diffusing combustion nozzle unit 32 creates a diffused flame 31*a* by the fuel a, it diffuses the fuel a in the direction of the lateral sectional surface of the combustion chamber 23. As a result, when the fuel a is ignited, the diffused flame 31*a* reaches a flame propagation pipe 60 which communicates a plurality of gas turbine combustors with each other to thereby propagate the diffused flame 31*a* to the other gas turbine combustors. The flow rate of the fuel a is gradually reduced while the load on the gas turbine increases and finally made to zero.

The fuel b injected from the first premixing combustion nozzle unit 33 is premixed by being added with the compressed air 30*a* and creates a first premixed flame 31*b* accompanied with a circulating flow in the premixing combustion chamber 36. In addition, the fuel c injected from the second premixing combustion nozzle unit 34 is premixed by being added with the compressed air 30*a* and creates a second premixed flame 31*c* in the combustion chamber 23 using the diffused flame 31*a* as a pilot flame.

The diffused flame 31*a*, the first premixed flame 31*b* and the second premixed flame 31*c* are guided to the gas turbine blade 25 through the combustor tail cylinder 26 as the combustion gas 31 for driving the gas turbine after they are joined. Further, the supply of the fuel a, which is injected from the diffusing combustion nozzle unit 32, is stopped in the gas turbine load increasing process. The first premixed flame 31*b* as the pilot flame, the second premixed flame 31*c* and the combustion gas 31 for driving the gas turbine are covered by the fuels b, c which are injected from the first premixing combustion nozzle unit 33 and the second premixing combustion nozzle unit 34.

Figure 2:
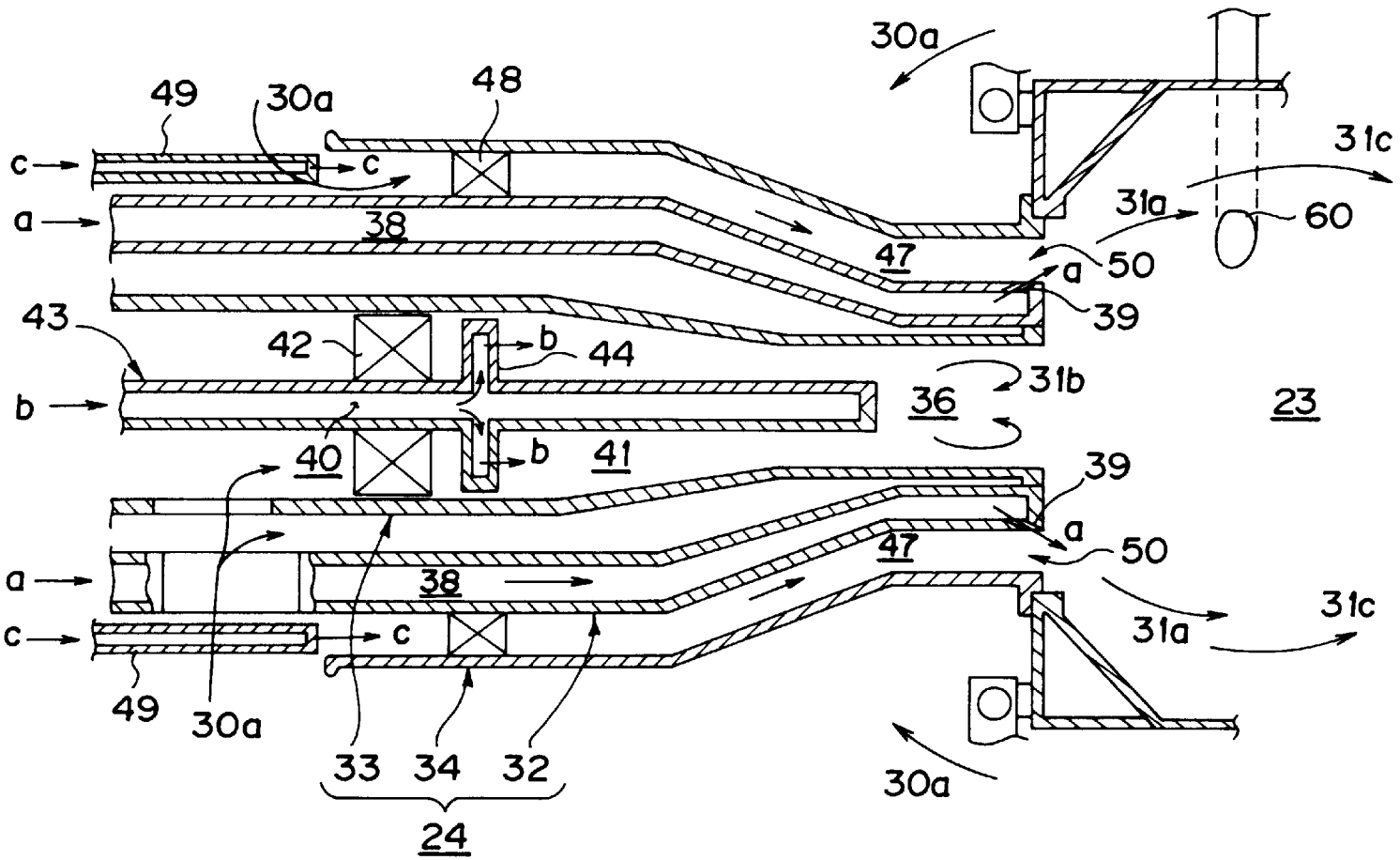
FIG. 2 is a partially enlarged view of FIG. 1.

FIG. 2 is a partially enlarged view of the pilot fuel injection unit 24 shown in FIG. 1. The arrangement of the pilot fuel injection unit 24 will be described somewhat in detail herein.

As shown in FIG. 2, the pilot fuel injection unit 24 is constructed by aggregating the individual diffusing combustion nozzle unit 32, first premixing combustion nozzle unit 33, second premixing combustion nozzle unit 34 and premixing combustion chamber 36 as a single unit.

The second premixing combustion nozzle unit 34 which is located farthest from the axial center of the pilot fuel injection unit 24 is provided with a second fuel nozzle 49, a swirler 48 and a second premixing premixed gas passage 47, respectively. In addition, the second premixing premixed gas passage 47 is formed to a narrowing passage by gradually narrowing its open area from the swirler 48 to a second premixing outlet 50. As a result, the fuel c injected from the second fuel nozzle 49 is made to a second premixed gas by being added with the air compressor 30 when it is injected and further applied with a swirling flow by the swirler 48. Thus, when the second premixed gas passes through the second premixing outlet 50 of the second premixing premixed gas passage 47, since it is injected into the combustion chamber 23 as the second premixed flame 31*c* at a fastest flow velocity, a stable combustion gas which does not flow reversely can be created.

Further, the diffusing combustion nozzle unit 32 coaxially surrounded by the second premixing combustion nozzle unit 34 is provided with an axially extending diffusing combustion fuel passage 38 as well as fuel injection holes 39 which are radially defined at the outlet of the diffusing combustion fuel passage 38 in the lateral sectional direction of the combustion chamber 23. As a result, the fuel a injected from the fuel injection holes 39 creates the diffused flame 31*a* using an igniter, not shown, when it is diffused and injected in the lateral sectional direction of the combustion chamber 23 and the diffused flame 31*a* reaches the flame propagation pipe 60 and is used as the pilot flame to the other gas turbine combustors.

On the other hand, the first premixing combustion nozzle unit 33 disposed at the center of the pilot fuel injection unit 24 is arranged as a first fuel nozzle 43 including an axially extending first premixing fuel passage 40. A first premixing premixed gas passage 41 is formed outwardly of the first fuel nozzle 43 so as to coaxially surround the same and a swirler 42 is disposed to the first premixing premixed gas passage 41. A premixed fuel injection unit 44 which laterally projects, in a crossing manner, toward the first premixing premixed gas passage 41 is disposed to the intermediate portion of the first fuel nozzle 43. In addition, the concave premixing combustion chamber 36 formed to be surrounded by the diffusing combustion nozzle unit 32, and the second premixing combustion nozzle unit 34 is disposed to the outlet of the first premixing premixed gas passage 41 so as to premix the fuel b injected from the first premixing fuel passage 40 through the premixed fuel injection unit 44 by adding it with the compressed air 30*a* to which the swirling flow is applied by the swirler 42 and then creates the first premixed flame 31*b* through the guidance of the premixed gas into the premixing combustion chamber 36.

The first premixing premixed gas passage 41 is formed to a throttling passage having an open area gradually narrowed from the premixed fuel injection unit 44 into the premixing combustion chamber 36 to set the flow velocity of the fuel b to 100 m/sec.–120 m/sec. As a result, since the flow velocity of the first premixed flame 31*b* created in the premixing combustion chamber 36 is made two or three times of that of a turbulent flame propagating velocity, it does not reversely flow to the first premixing premixed gas passage 41.

On the other hand, since the premixing combustion chamber 36 is formed to the concave shape formed by being surrounded by the diffusing combustion nozzle unit 32 and the second premixing combustion nozzle unit 34, and the diameter thereof is greatly reduced as compared with that of the combustion chamber 23. Accordingly, the premixing combustion chamber 36 is affected by the great turbulence of the combustion gas flow in the combustion chamber 23 and the compressed air flow. Therefore, the stability of the first premixed flame 31*b* created in the premixing combustion chamber 36 depends only on the degree of dilution of the fuel b itself and its flow velocity and does not receive the effect of the disturbance at all.

Further, since the volume of the premixing combustion chamber 36 is greatly smaller than that of the combustion chamber 23, the ratio of the fuel b which is combusted per unit volume of the combustion chamber and per unit time (fuel load ratio) is increased. As a result, since the stability of the first premixed flame 31*b* can be certainly secured, even if the premixed combustion is carried out by simultaneously using the first premixing combustion nozzle unit 33 and the second premixing combustion nozzle unit 34 during the 100% load operation, the first premixed flame 31*b* can maintain its state as the pilot flame.

Figure 3:
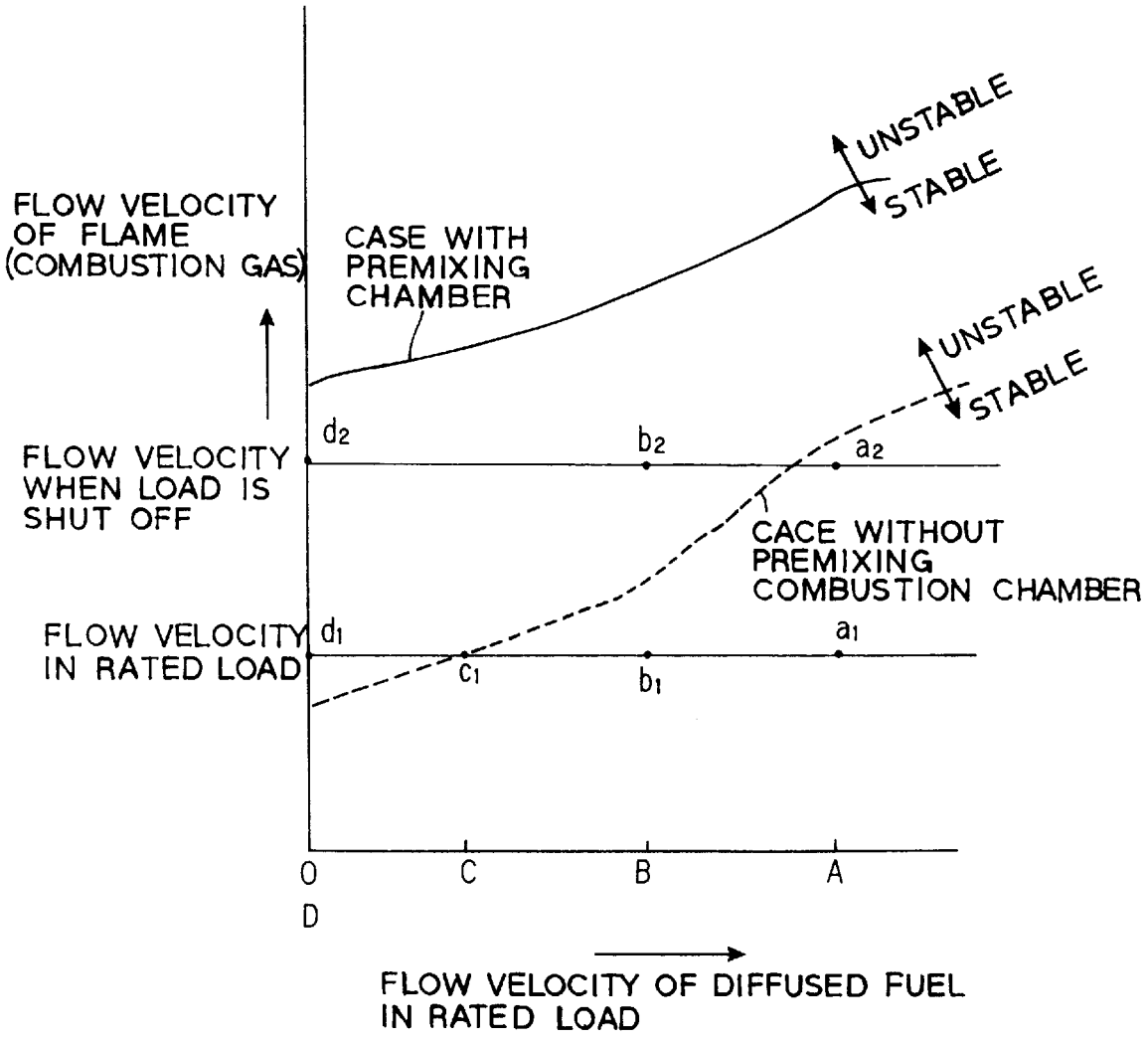
FIG. 3 is a graph describing stability of a flame from the relationship between a flow rate of a diffused fuel and a flow velocity of the flame in a rated load.

FIG. 3 is a characteristic graph showing how the presence and absence of a diffused fuel affect the stability of a flame. In FIG. 3, a solid line shows whether the flame in the premixing combustion chamber 36 according to this embodiment is stable or not and a broken line shows whether a flame in the conventional gas turbine combustor shown in FIG. 17 (provided with no premixing combustion chamber) is stable or not.

In general, the flow velocity of a combustion gas is unconditionally determined with respect to the loads in a gas turbine plant, and the flow velocity of the combustion gas does not change to the same load. However, when the total pressure loss of the gas turbine combustor is intentionally changed in the state of a rated load, and more specifically, when the premixing combustion chamber 36 is provided as in the case of the described embodiment, there will be caused a problem of the stability of flame to diffused fuel.

Figure 18:
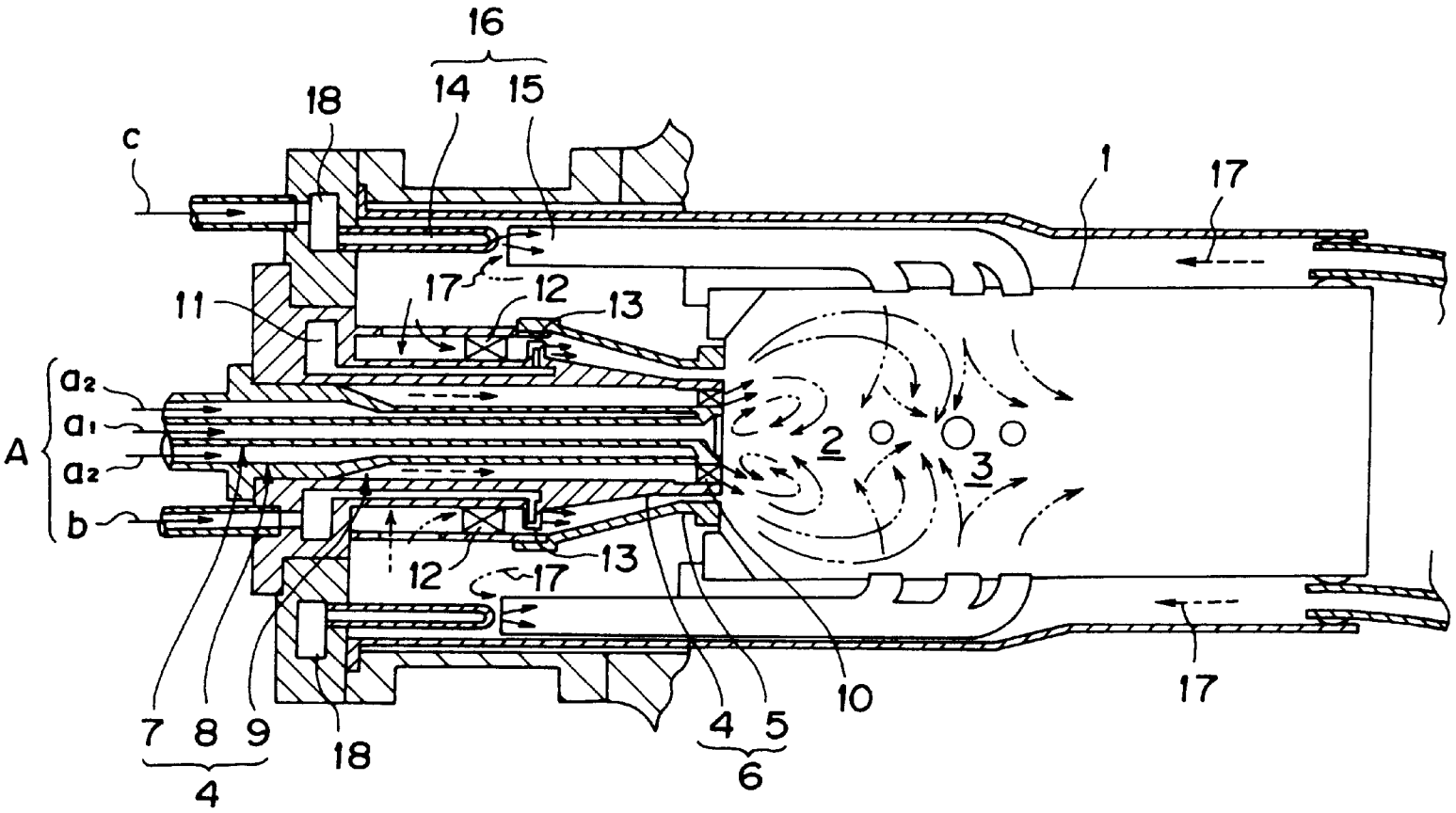
FIG. 18 PRIOR ART
FIG. 18 is a schematic sectional view, partly cut away, showing an embodiment of a conventional gas turbine combustor.
Figure 19:
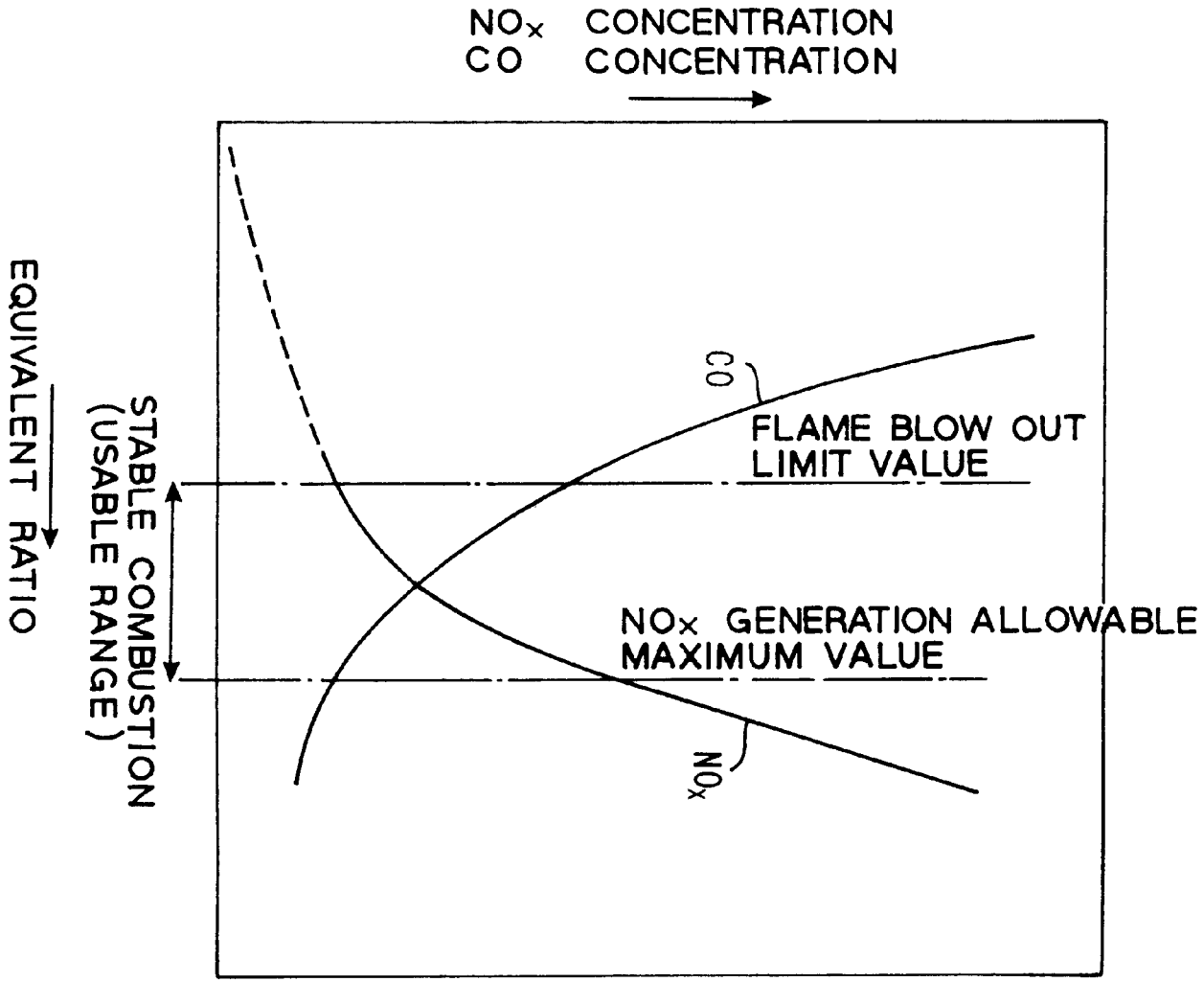
FIG. 19 is a graph showing the relationship among an equivalent ratio, an NOx concentration and a CO concentration.
Figure 20:
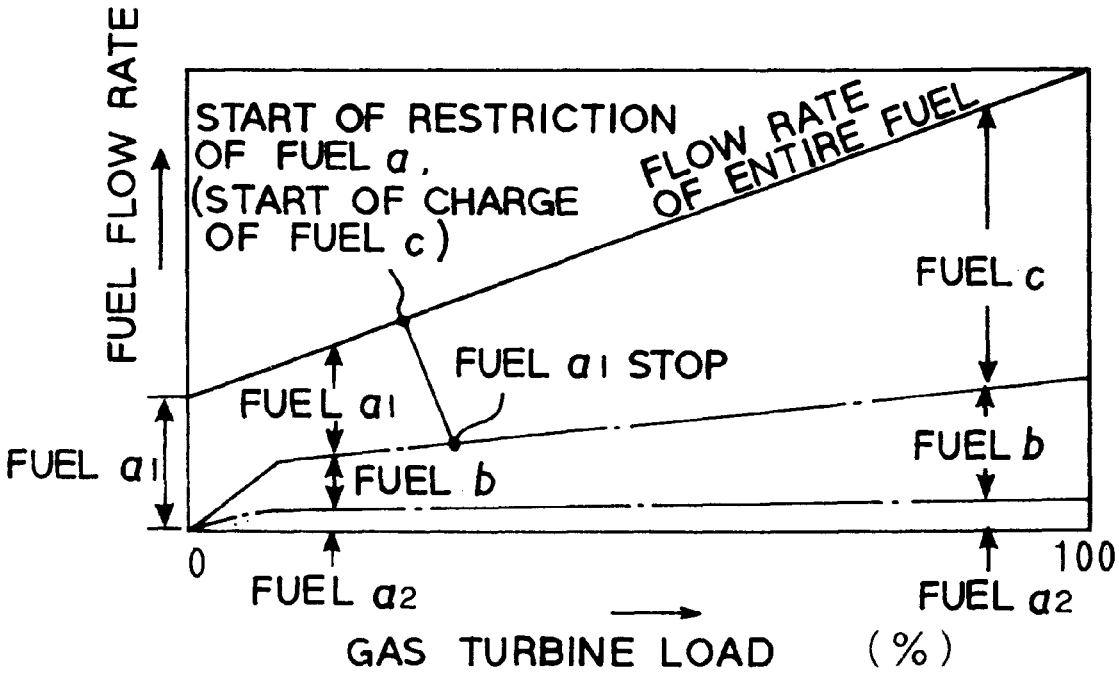
FIG. 20 is a view describing the charge and distribution of a fuel in a conventional gas turbine combustor.

That is, in the conventional gas turbine combustor shown in FIG. 18, when the flow rate of a diffused fuel is represented by a value A, the flow velocity of a combustion gas is represented by al in a rated load operation, whereas the flow velocity of the combustion gas is represented by a2 when a load is shut off and the stability of a flame is secured in both the cases.

However, when the flow rate of the diffused fuel is shifted to a value B, even if the flow velocity of the combustion gas is made to b1 in the rated load operation, the stability of the flame can be ensured, whereas, in the load shut-off operation, the flow velocity of the combustion gas is made to b2, entering a flame gas unstable region.

Further, when the flow rate of the diffused fuel is zero, that is, when rated load operation is carried out and when the load is shut off at a position D, since the respective flow velocities d1 and d2 of the combustion gas exceed the broken line, the flame is made unstable and there may cause a possibility of blow-out phenomenon.

As described above, in the conventional gas turbine combustor shown in FIG. 18, the stability of the flame is secured only when the flow rate of the diffused fuel is set to the value A, taking the rated load operation and the shut-off of the load into consideration as a whole.

However, in the gas turbine combustor according to the described embodiment, since the respective flow velocities d1 and d2 of the combustion gas is located below the solid line in the rated load operation and when the load is shut off by the provision of the premixing combustion chamber 36, the stability of a flame is secured.

As described above, it is considered that the reason why the stability of the flame can be ensured even in no diffused fuel resides in that the premixing combustion chamber 36 is formed to provide a concave shape at the central portion of the pilot fuel injection unit 24 affected so that the chamber 36 is not affected by the disturbance of the flow of the combustion gas 31 in the combustion chamber 23 and the compressed air 30*a*.

Figure 4:
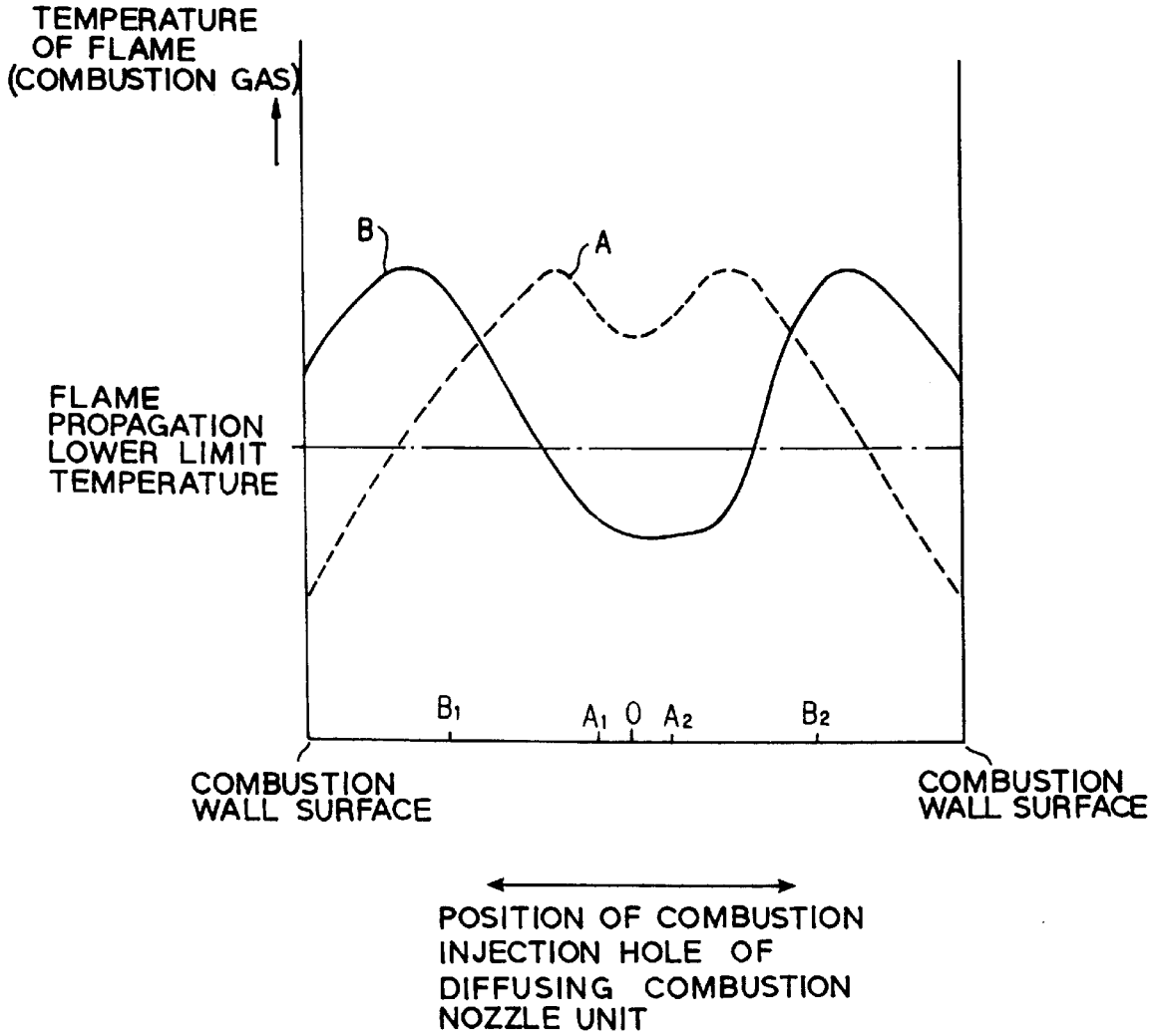
FIG. 4 is a graph describing a temperature distribution of the flame from the relationship between the position of a fuel injection hole of a diffusing fuel nozzle unit and a flame propagation pipe.

FIG. 4 is a graph for showing a temperature distribution characteristics for comparing the temperature distribution B of the flame when the fuel injection holes 39 of the diffusing combustion nozzle unit 32 according to the embodiment are located at positions B1, B2 spaced apart from the center O of the gas turbine combustor with the temperature distribution A of the flame when the fuel injection holes 39 of the conventional first diffusing combustion nozzle unit 7 are located at positions A1 and A2 spaced apart from the center O of the gas turbine combustor.

As shown in the broken line in FIG. 4, the conventional flame temperature distribution A has a peak temperature value in the vicinity of the center O of the gas turbine combustor, whereas it has a value near to a flame propagation lower limit temperature on the wall surface of the combustion chamber at the inlet of the flame propagation pipe and, accordingly, the temperature distribution is in an unstable state.

On the other hand, as shown by the solid line in FIG. 4, the temperature distribution according to the present embodiment has a peak value outside of the positions B1 and B2 and a temperature value above the flame propagation lower limit temperature even on the wall surface of the combustion chamber.

As described above, since the fuel injection holes 39 of the diffusing combustion nozzle unit 32 are disposed at the positions B which are spaced apart from the center O of the gas turbine combustor as well as defined in the direction toward the wall surface of the combustion chamber 23 in this embodiment, the flame can be surely propagated to the other gas turbine combustors.

Figure 5:
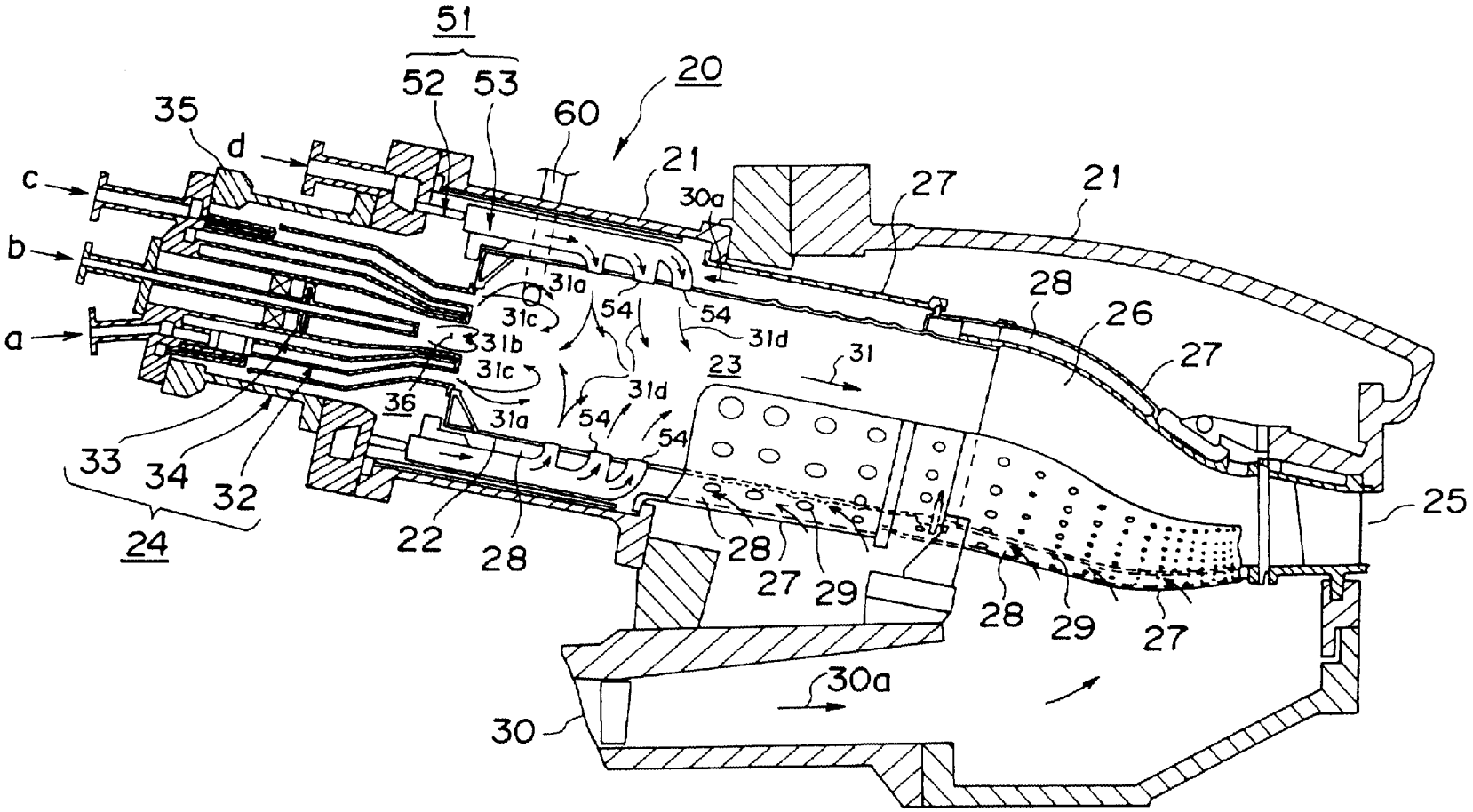
FIG. 5 is a schematic sectional view, partly cut away, showing a second embodiment of a gas turbine combustor according to the present invention.

FIG. 5 is a schematic sectional view, partly cut away, showing a second embodiment of a gas turbine combustor according to the present invention, in which the same components as those in the first embodiment are denoted by the same reference numerals and only different components will be described hereunder.

The second embodiment is provided with a main premixing fuel injection unit 51 disposed outwardly of the pilot fuel injection unit 24 to cope with the temperature increase of the gas turbine combustor 20.

The main premixing fuel injection unit 51 includes a main fuel nozzle unit 52 and a premixing duct 53 and serves to add the compressed air 30*a* to the fuel d injected from the main fuel nozzle unit 52. The the fuel d becomes to a premixed gas in a lean fuel state in the premixing duct 53.

The premixing duct 53 includes a plurality of main premixing fuel outlets 54 on the downstream side thereof and serves to inject the fuel d made to the premixed gas through the plurality of main premixing fuel outlets 54 rearwardly of the diffused flame 31*a*, first premixed flame 31*b* and second premixed flame 31*c* which are created by the respective ones of the diffusing combustion nozzle unit 32, first premixing combustion nozzle unit 33 and second premixing combustion nozzle unit 34 of the above pilot fuel injection unit 24. Then, a third premixed flame 31*d* as the combustion gas 31 is created for driving the gas turbine by using these flames 31*a*, 31*b*, 31*c* as pilot flames.

As described above, in this embodiment, since the third premixed flame 31*d* as the combustion gas 31 for driving the gas turbine which is created by the main premixing fuel injection unit 51 is added to the respective flames 31*a*, 31*b*, 31*c* as the combustion gas 31 for driving the gas turbine which are created by the pilot fuel injection unit 24, the power of the gas turbine can be increased by the increase of temperature of the gas turbine combustor 20.

Figure 6:
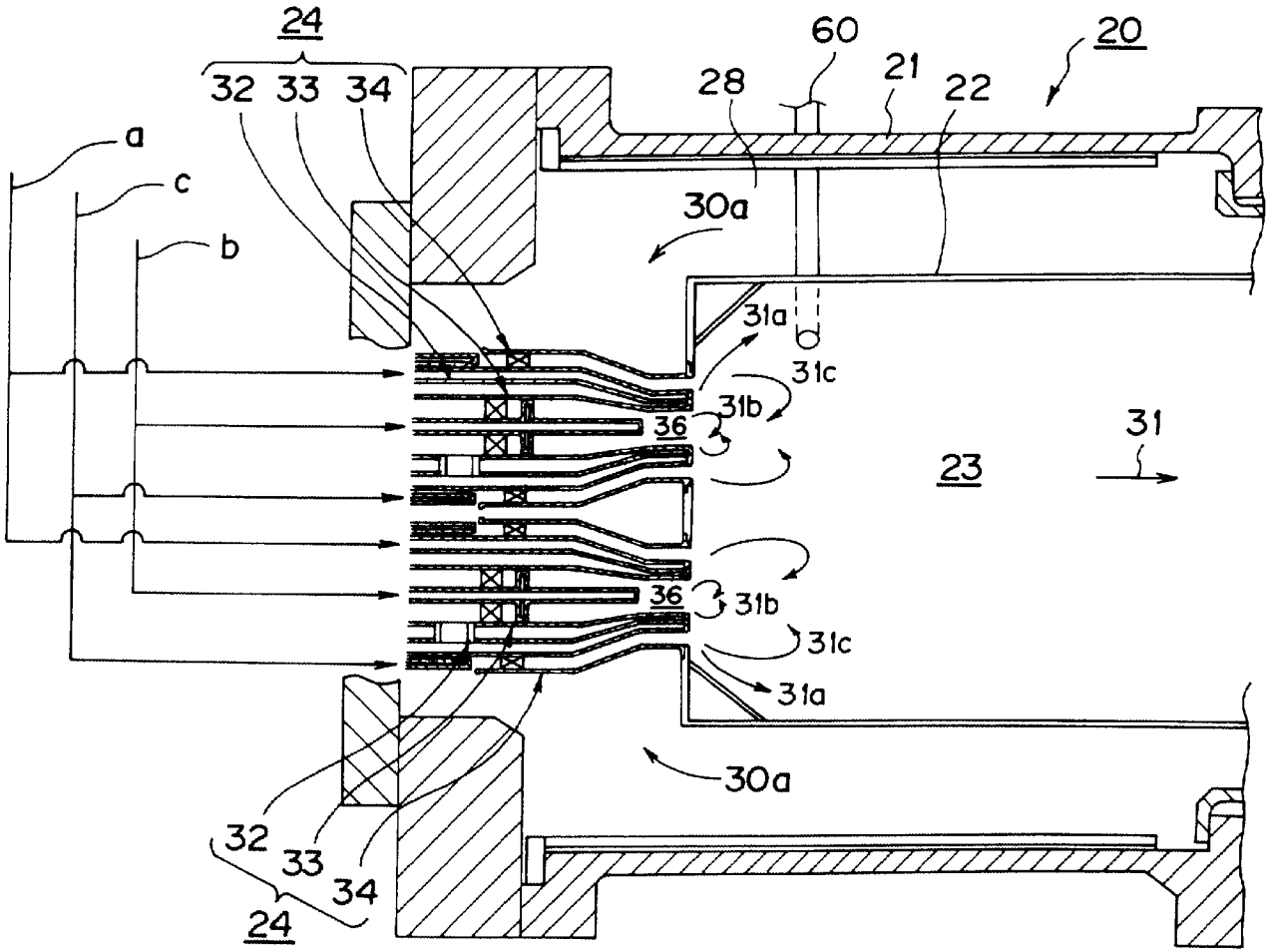
FIG. 6 is a schematic sectional view, partly cut away, showing a third embodiment of a gas turbine combustor according to the present invention.

FIG. 6 is a schematic sectional view, partly cut away, showing a third embodiment of a gas turbine combustor according to the present invention.

This third embodiment is provided with a plurality of the pilot fuel injection units 24 which are disposed to the head portion of the combustion chamber 23 formed in the combustor inner cylinder 22 in the first embodiment or the second embodiment, in which the same components as those in the first embodiment or the second embodiment are denoted by the same reference numerals.

In this embodiment, there is provided with the plurality of pilot fuel injection units 24 each having the respective ones of the diffusing combustion nozzle unit 32, the first premixing combustion nozzle unit 33 and the second premixing combustion nozzle unit 34, and accordingly, the unevenness of the temperature distribution of the diffused flame 31*a*, first premixed flame 31*b* and second premixed flame 31*c* is eliminated by the increase of the number of the respective nozzle units, so that thermal stability can be increased.

Therefore, the vibration due to the combustion which is caused when the respective flames 31*a*, 31*b* and 31*c* are created can be suppressed to a lower level according to this third embodiment.

Figure 7:
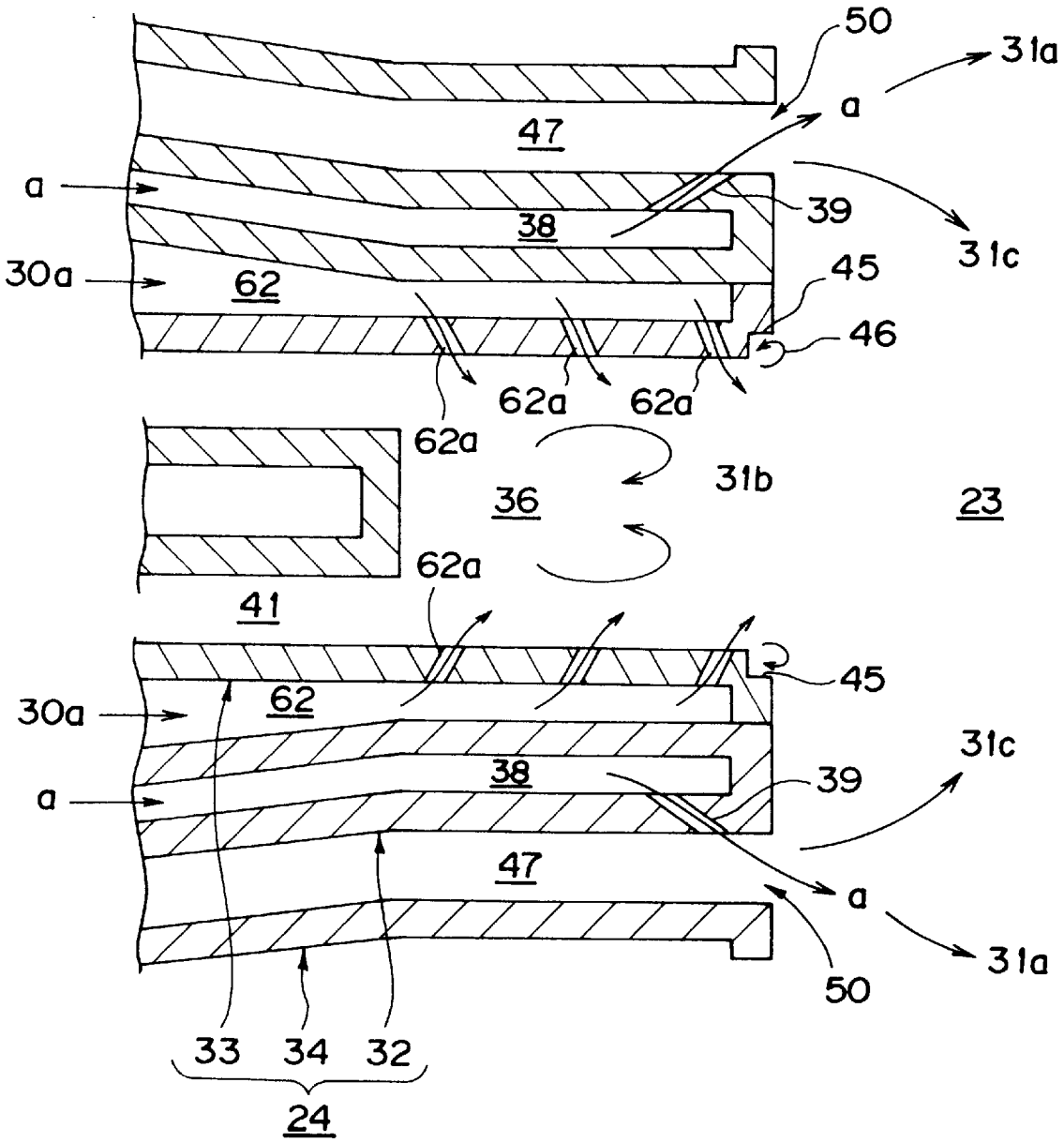
FIG. 7 is a partial schematic sectional view showing a first example of a gas turbine combustor according to each of the above embodiments of the present invention.

FIG. 7 is a partial schematic sectional view showing a first example for carrying out the first embodiment, second embodiment or third embodiment of a gas turbine combustor according to the present invention.

In the first example, injection holes 62*a* is formed to the premixing combustion chamber 36 of the first premixing combustion nozzle unit 33 so that the injection holes 62*a* communicate with a compressed air passage 62, and a cutout 45 is formed to the outlet of the premixing combustion chamber 36 of the first, second or third embodiment. Further, the same components as those of the respective embodiments are denoted by the same reference numerals.

Since the volume of the premixing combustion chamber 36 is smaller than that of the combustion chamber 23, the fuel load ratio per unit time and per unit volume is increased.

As a result, when the gas turbine is in rated operation, since the premixing combustion chamber 36 is exposed to a severe state by the first premixed flame 31*b*, there is a possibility that the wall surface which forms the compressed air passage 62 may be burnt.

Further, the flow velocity of the first premixed flame 31*b* created in the premixing combustion chamber 36 is increased by the increase of rotation (increase of velocity) of the gas turbine. At the time, there is a case that the first premixed flame 31 moves from the premixing combustion chamber 36 into the combustion chamber 23 by the increase of the flow velocity or, on the contrary, from the combustion chamber 23 into the premixing combustion chamber 36. Accordingly, there is a possibility that the vibration due to the combustion is induced to the premixing combustion chamber 36 by the first premixed flame 31*b*.

To cope with the above problem, in this example the injection holes 62*a* are formed to the wall surface of the compressed air passage 62 which forms the premixing combustion chamber 36 by surrounding it and the wall surface is cooled. The step-like cutout 45 is also formed to the outlet of the premixing combustion chamber 36 to thereby prevent the staggering movement of the first premixed flame 31*b* by making use of the adhering force of swirls 46 generated there.

Therefore, according to this first example, since the injection holes 62*a* are defined to the premixing combustion chamber 36 so as to communicate with the compressed air passage 62 and the wall surface which forms the premixing combustion chamber 36 is cooled by the compressed air 30*a*, the wall surface can be prevented from being burnt by the first premixed flame 31*b*.

Further, according to this example, since the cutout 45 is formed to the outlet of the premixing combustion chamber 36 and the staggering movement of the first premixed flame 31*b* is prevented by making use of the adhering force of the swirls 46 generated by the cutout 45, the vibration in the premixing combustion chamber 36 generated by the first premixed flame 31*b* can be prevented.

Figure 8:
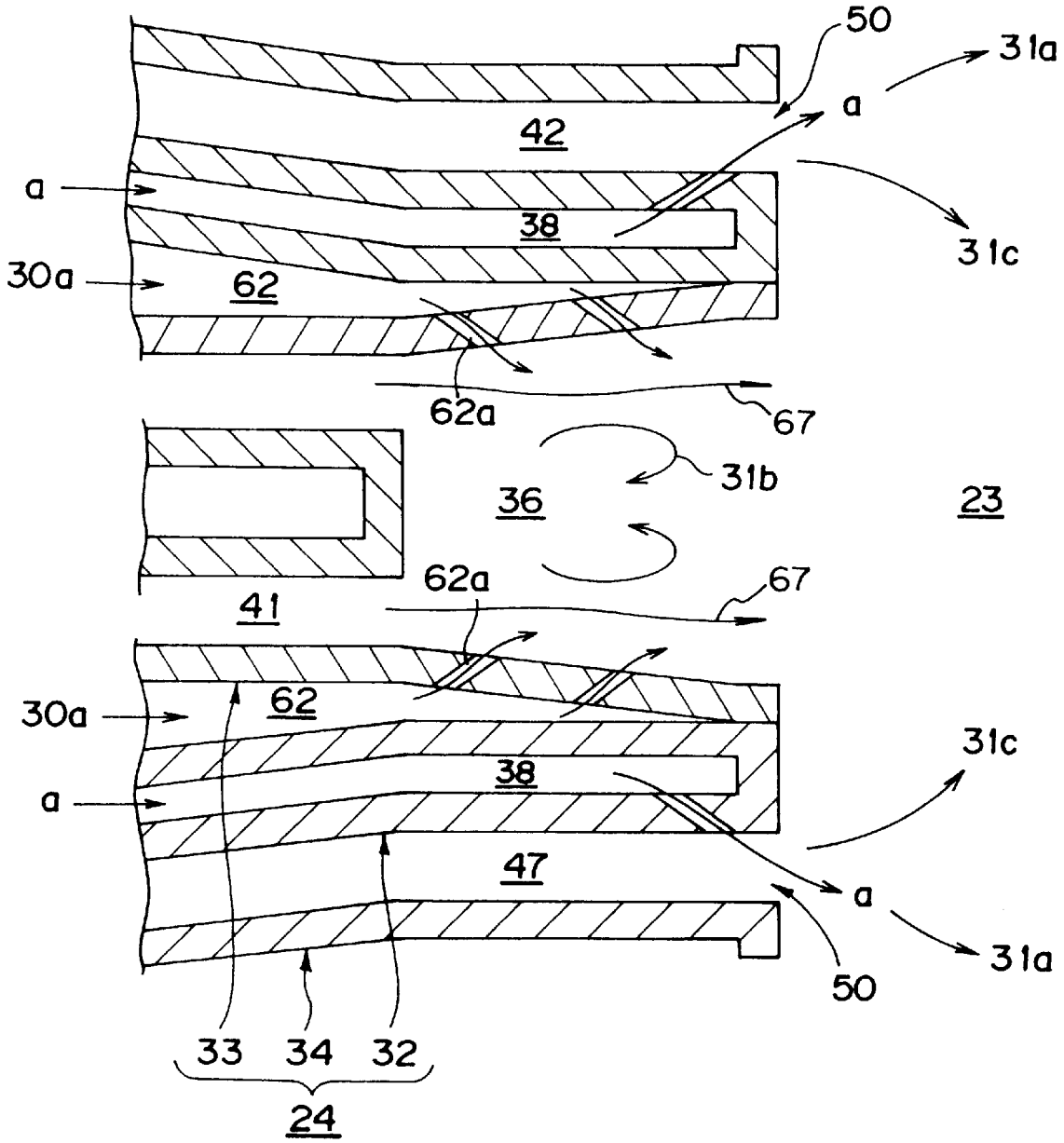
FIG. 8 is a partial schematic sectional view showing a second example of a gas turbine combustor according to the above embodiments.

FIG. 8 is a partial schematic sectional view showing a second example for carrying out the first embodiment, second embodiment or third embodiment of the gas turbine combustor according to the present invention.

In this second example, the premixing combustion chamber 36 is formed of the first premixing combustion nozzle unit 33 to a conical shape so that it is expanded toward the combustion chamber 23 of the first, second or third embodiment. Further, the same components as those of the respective embodiments are denoted by the same reference numerals.

According to this example, since a swirling combustion gas flow 67 smoothly flows along a conical wall surface even if the compressed air 30*a* varies, the size of the reverse flow region of the first premixed flame 31*b* at the central portion can be made constant.

Further, even if the pressure in the reverse flow region of the first premixed flame 31*b* is increased by the variation of the combustion gas in the combustion chamber 23 and an external force for expanding the swirling combustion gas flow 67 outwardly is applied thereto by the pressure increase, the swirling combustion gas flow 67 is not almost affected by this force due to the conical shape, so that the reverse flow region of the first premixed flame 31*b* is not almost changed though its position is slightly moved rearwardly.

On the contrary, even if a force for drawing the swirling combustion gas flow 67 inwardly is applied thereto by decreasing the pressure of the first premixed flame 31*b* in the reverse flow region, since the swirling combustion gas flow 67 flows while adhering to the wall surface, it is not simply exfoliated therefrom and the reverse flow region of the first premixed flame 31*b* is not almost changed.

As a result, the combustion can be stably continued and the occurrence of the vibration due to the combustion can be suppressed.

Figure 9:
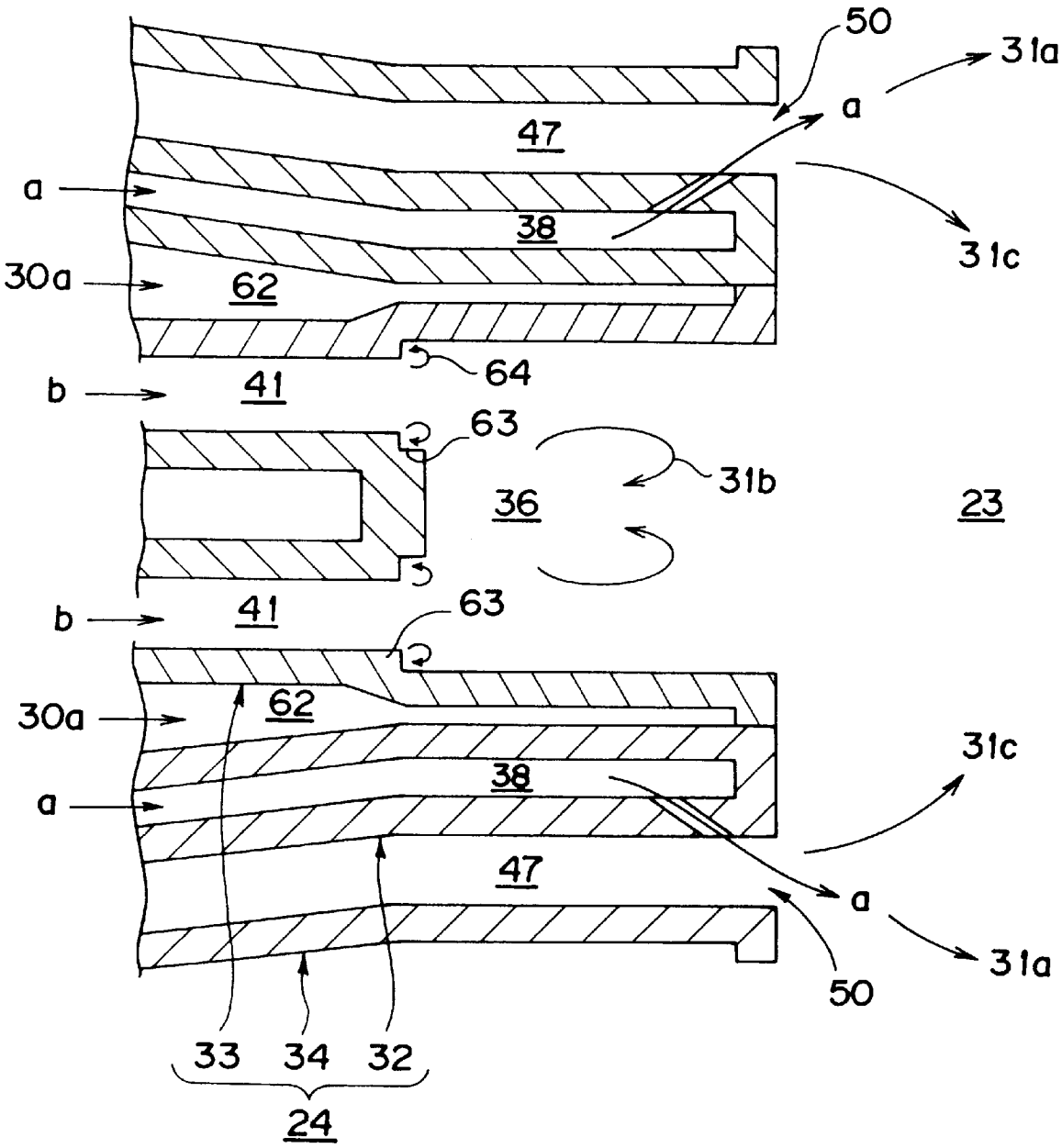
FIG. 9 is a partial schematic sectional view showing a third example of a gas turbine combustor according to the above embodiments.

FIG. 9 is a partial schematic sectional view showing a third example for carrying out the first embodiment, second embodiment or third embodiment of the gas turbine combustor according to the present invention.

In this example, a step-like cutout 63 is formed to the outlet of the first premixing premixed gas passage 41 of the first premixing combustion nozzle unit 33 in the first, second or third embodiment. Further, the same components as those of the respective embodiments are denoted by the same reference numerals.

Generally, since the flow velocity of the fuel b passing through the first premixing premixed gas passage 41 is increased by the increase of velocity of the gas turbine, the first premixed flame 31*b* created in the premixing combustion chamber 36 is injected into the combustion chamber 23 while also increasing its flow velocity. In this case, the first premixed flame 31*b* is adhered to or exfoliated from the wall surface of the outlet of the first premixing premixed gas passage 41 to thereby disturb the flow thereof in the process where the fuel b is created to the first premixed flame 31*b*, by which the vibration due to the combustion may be caused.

To cope with this problem, in the third example, the cutout 63 is formed to the outlet of the first premixing premixed gas passage 41 and small swirls 64 are generated there to thereby prevent the behavior of the first premixed flame 31*b* for adhering it to or exfoliating it from the wall surface of the outlet of the first premixing premixed gas passage 41 by making use of the adhering force of the swirls 64.

Therefore, according to this example, since the staggering movement of the first premixed flame 31*b* is prevented by forming the step-like cutout 63 to the outlet of the first premixing premixed gas passage 41 and making use of the adhering force of the swirls 64 generated at the cutout 63, the vibration at the outlet of the first premixing premixed gas passage 41 caused by the first premixed flame 31*b* can be prevented.

Figure 10:
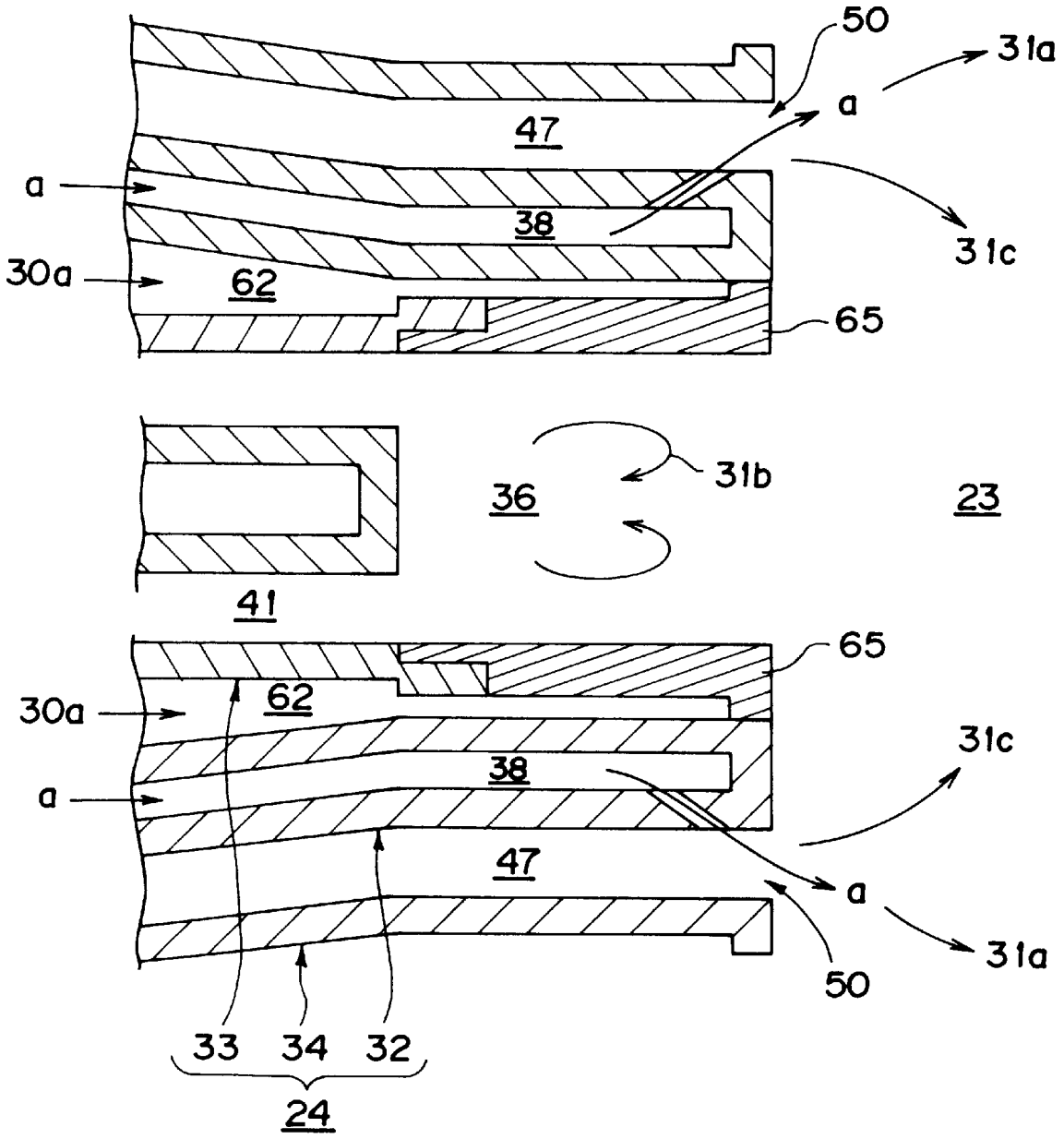
FIG. 10 is a schematic sectional view partly showing a fourth example of a gas turbine combustor according to the above embodiments.

FIG. 10 is a partial schematic sectional view showing a fourth example for carrying out the first embodiment, second embodiment or third embodiment of the gas turbine combustor according to the present invention. Further, the same components as those of the respective embodiments are denoted by the same reference numerals.

In this fourth example, a wall surface 65 forming the premixing combustion chamber 36 is formed of the first premixing combustion nozzle unit 33 of ceramics or a ceramics-fiber-reinforced composite material of the first second or third embodiment.

In general, although the compressed air 30*a* used to premix the fuel of the gas turbine combustor to the lean fuel state is supplied from the air compressor, the flow rate thereof is limited. Furthermore, when it is taken into consideration that the compressed air 30*a* supplied from the compressor is supplied to cool the components such as the combustor inner cylinder 22, combustor tail cylinder 26, gas turbine blade 25 and so on in addition to the premixing of the fuel, it is desired to minimize the flow rate of the compressed air used to cool the combustor inner cylinder. This is because that the flow rate of the compressed air used to premix the fuel can be increased accordingly and the gas turbine can be operated in a leaner fuel state. Further, in a method of cooling the metal wall surface of the inner cylinder by injecting cooling air into the inner cylinder, the temperature of the wall surface of inner cylinder is lowered and an uncombusted premixed gas is made leaner by the cooling air and exhausted as it is as uncombusted fuel without making reaction.

Figure 11:
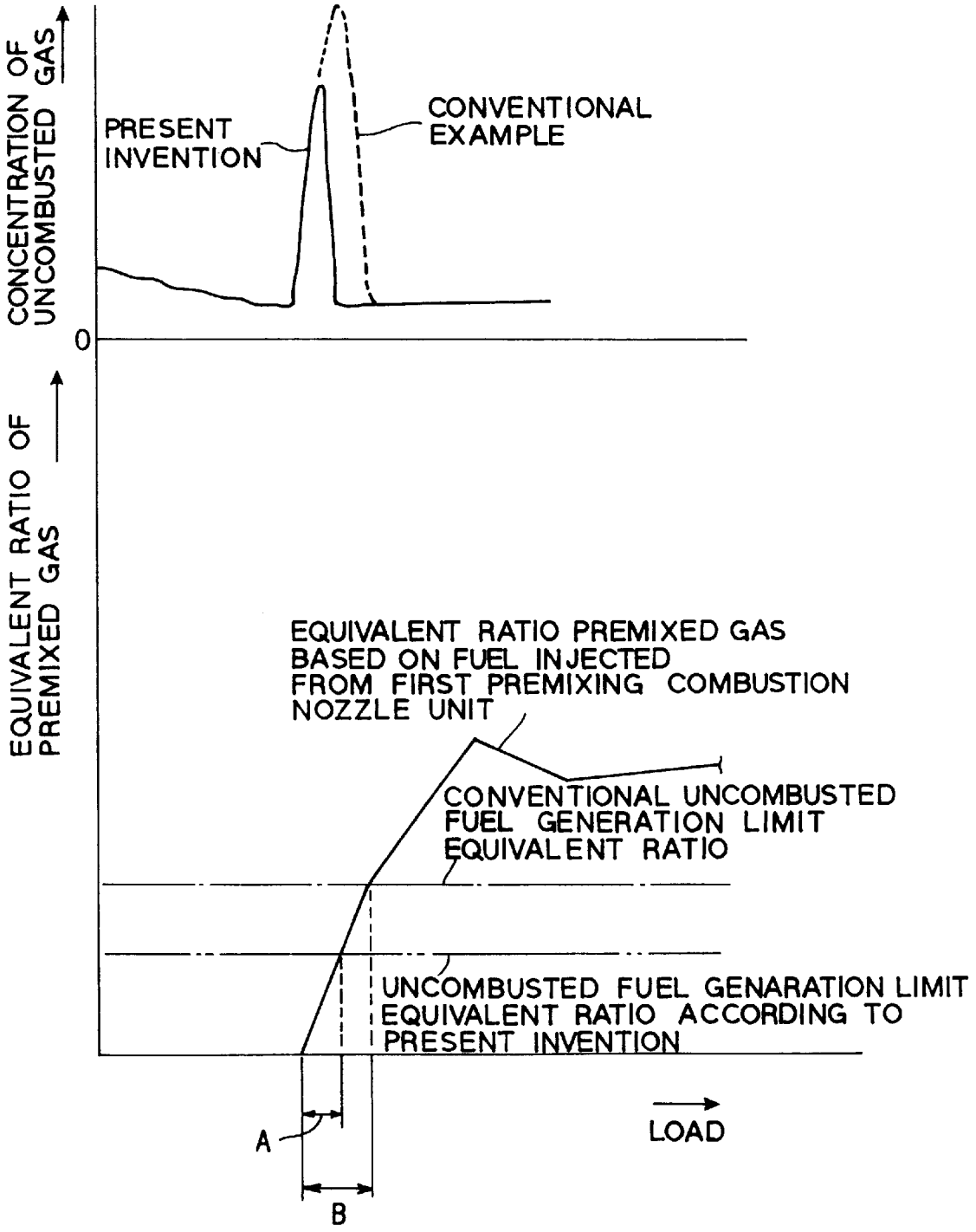
FIG. 11 is a graph showing the relationship among a load, an equivalent ratio of a premixed gas and an unburnt fuel concentration.

Taking the above matters into consideration, in this fourth example, the wall surface 65 forming the premixing combustion chamber 36 is formed of the ceramics or the ceramics-fiber-reinforced composite material to thereby increase the temperature of the wall surface 65, so that the fuel uncombusted state is more reduced by the increase of the temperature of the wall surface 65. That is, since the temperature of the wall surface 65 is increased by making it of the ceramics or the ceramics-fiber-reinforced composite material in this example, the uncombusted fuel generation limit equivalent ratio of the premixed gas which is injected from the first premixing combustion nozzle unit 33 into the premixing combustion chamber 36 can be lowered from the conventional limit equivalent ratio shown by a dot-dash-line to the limit equivalent ratio shown by a two-dot-and-dash-line in FIG. 11. The uncombusted fuel generation range A in the start-up operation of the gas turbine can be narrowed as compared with a conventional uncombusted fuel generation range B by the decrease of the uncombusted fuel generation limit equivalent ratio. Further, the concentration of the uncombusted fuel can be decreased as shown by a solid line as compared with the conventional concentration shown by a broken line.

Therefore, since the wall surface 65 is formed of the ceramics or the ceramics-fiber-reinforced composite material and the temperature thereof is increased in this example, the generation of the uncombusted fuel in the premixed gas which flows along the wall surface 65 can be decreased and the compressed air 30*a* used otherwise to cool the portion can be used for premixing, whereby the NOx to be generated can be more reduced.

Figure 12:
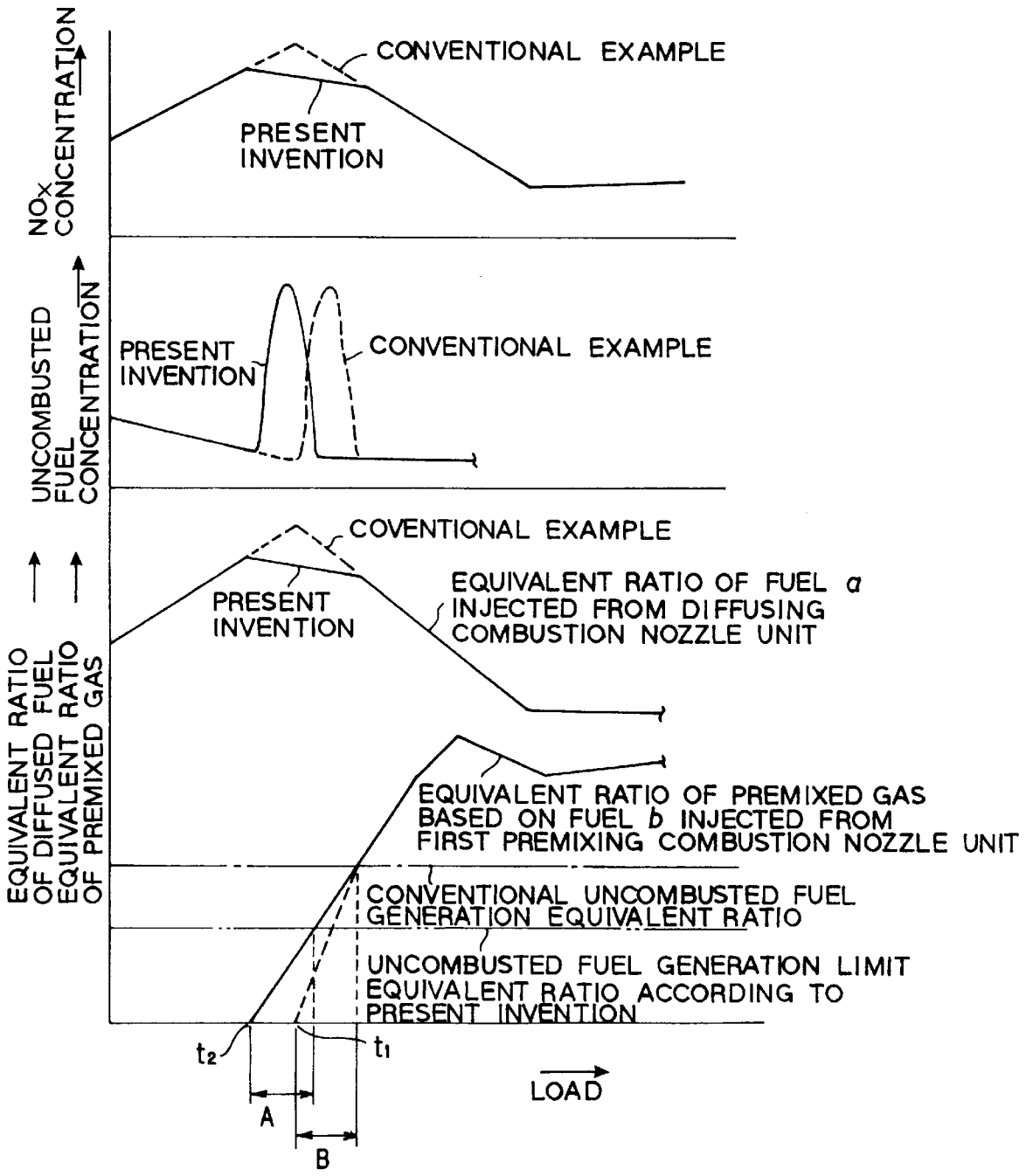
FIG. 12 is a graph showing the relationship among the load, an equivalent ratio of a mixed gas, an equivalent ratio of a diffused fuel, an unburnt fuel concentration and a NOx concentration.

Further, according to this fourth example, since the uncombusted fuel generation limit equivalent ratio can be more decreased than the conventional one, the timing at which the fuel b is injected from the first premixing combustion nozzle unit 33 into the premixing combustion chamber 36 is advanced, and the flow rate of the fuel a which is injected from the diffusing combustion nozzle unit 32 into the combustion chamber 23 can be therefore reduced than the conventional one. That is, the injection of the fuel b from the first premixing combustion nozzle unit 33 is started at a time t1 during the start-up operation of the gas turbine as shown in FIG. 12. However, since the wall surface 65 forming the premixing combustion chamber 36 is formed of the ceramic or the ceramics-fiber-reinforced composite material to thereby reduce the generation of the uncombusted fuel in the premixed gas flowing along the wall surface 65 by the increase of the temperature of the wall surface 65, the time t1 can be advanced to a time t2. As a result, the fuel a injected from the diffusing combustion nozzle unit 33, which is formed by concentrically surrounding the first premixing combustion nozzle unit 33, can be reduced from the conventional flow rate shown by a broken line to the flow rate shown by a solid line in FIG. 12, and the peak value of the concentration of the uncombusted fuel can advance from the time shown by a broken line to that shown by a solid line. Furthermore, the peak value of the NOx concentration can be suppressed to be lower from the value shown by a broken line to the value shown by a solid line.

As described above, in this example, since the wall surface 65 is formed of the ceramics or the ceramics-fiber-reinforced composite material and the temperature thereof is increased, the timing at which the fuel b is injected from the first premixing combustion nozzle unit 33 into the premixing combustion chamber 36 is advanced from the conventional timing and the flow rate of the fuel a injected from the diffusing combustion nozzle unit 32 into the combustion chamber 23 is reduced, whereby the NOx concentration can be more reduced than the conventional one even during the start-up operation.

Figure 13:
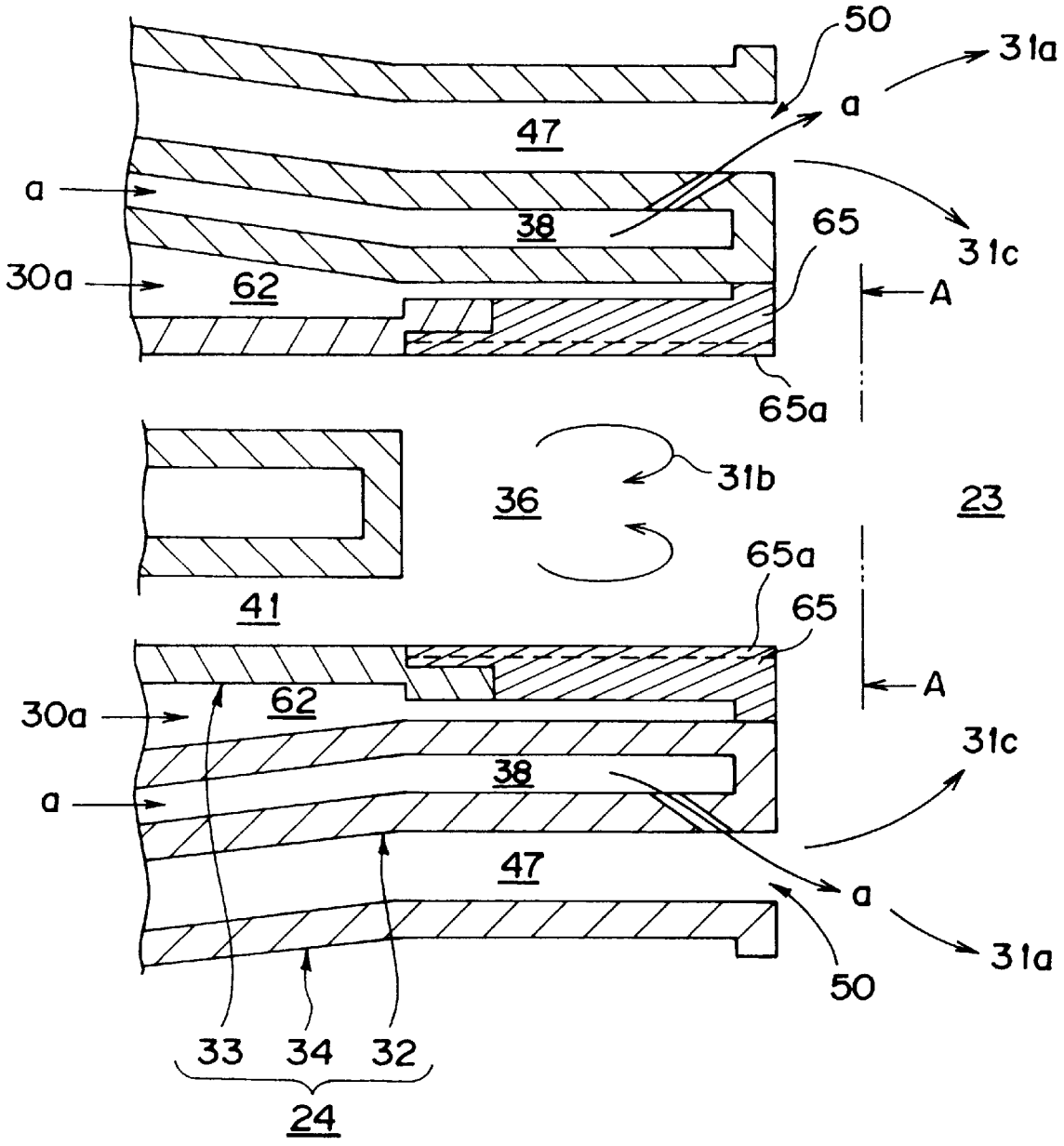
FIG. 13 is a schematic sectional view partly showing a fifth example of a gas turbine combustor according to the above embodiments.

FIG. 13 is a partial schematic sectional view showing a fifth example for carrying out the first embodiment, second embodiment or third embodiment of the gas turbine combustor according to the present invention.

In this fifth example, the wall surface 65 forming the premixing combustion chamber 36 is formed of the first premixing combustion nozzle unit 33 of the ceramics or the ceramics-fiber-reinforced composite material and projecting pieces 65*a* are formed to the wall surface 65 integrally therewith as in the first, second or third embodiment. Further, the same components as those of the respective embodiments are denoted by the same reference numerals.

Figure 14:
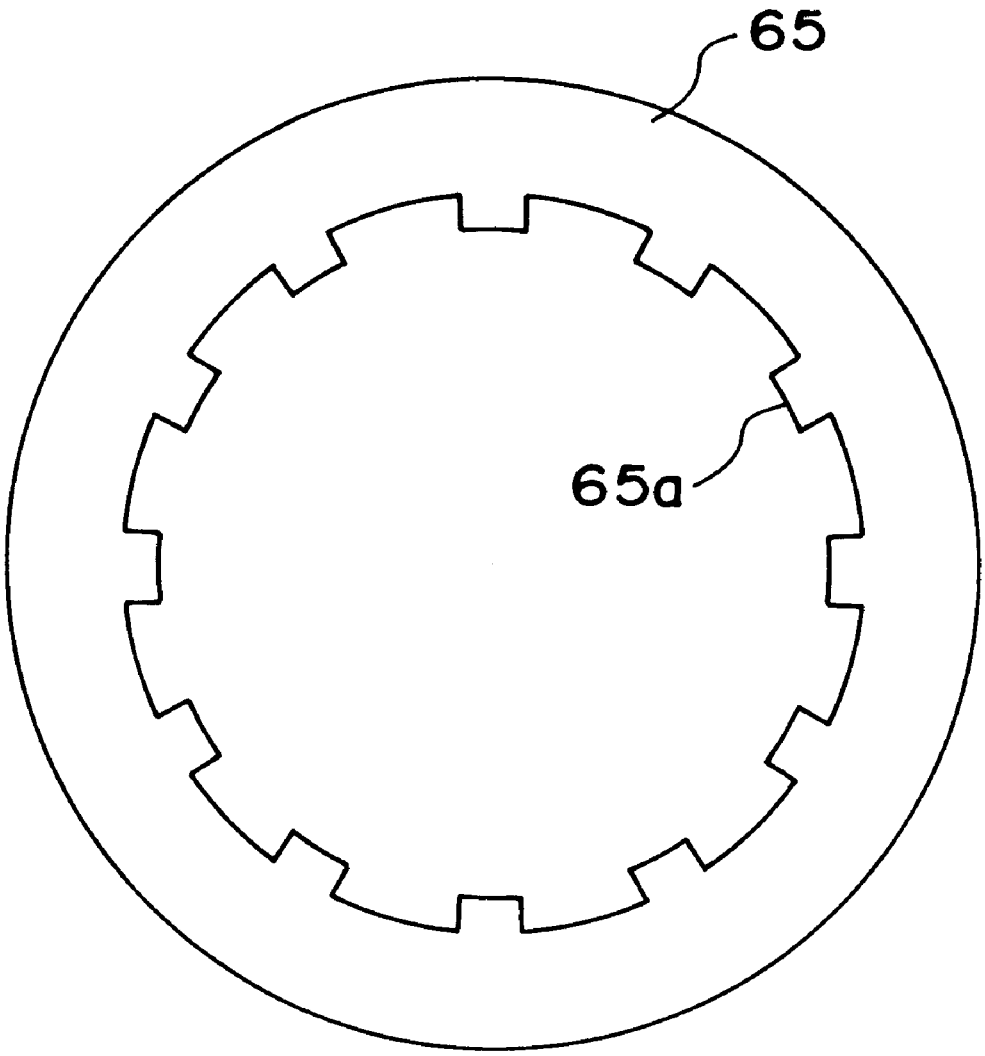
FIG. 14 is a front elevational view observed from the direction of the arrow shown by the line XIV-XIV in FIG. 13.

As shown in FIG. 14, the projecting pieces 65*a* formed to the wall surface 65 integrally therewith are disposed in annular shape along the peripheral direction of the wall surface 65 and extend in the axial direction of the wall surface 65.

As described above, according to this example, a heat transfer area is increased by forming the projecting pieces 65*a* to the wall surface 65 formed of the ceramics or the ceramics-fiber-reinforced composite material integrally therewith, whereas a disturbance is applied to the flow of the premixed gas injected from the first premixing premixed gas passage 41 into the premixing combustion chamber 36 in order that a combustion reaction is effectively promoted.

Therefore, since the temperature of the wall surface 65 can be more increased by the increase of the heat transfer area and the combusting reaction is promoted by applying the disturbance to the flow of the premixed gas by the projecting pieces 65*a*, the creation of the uncombusted fuel in the premixed gas can be more reduced.

Figure 15:
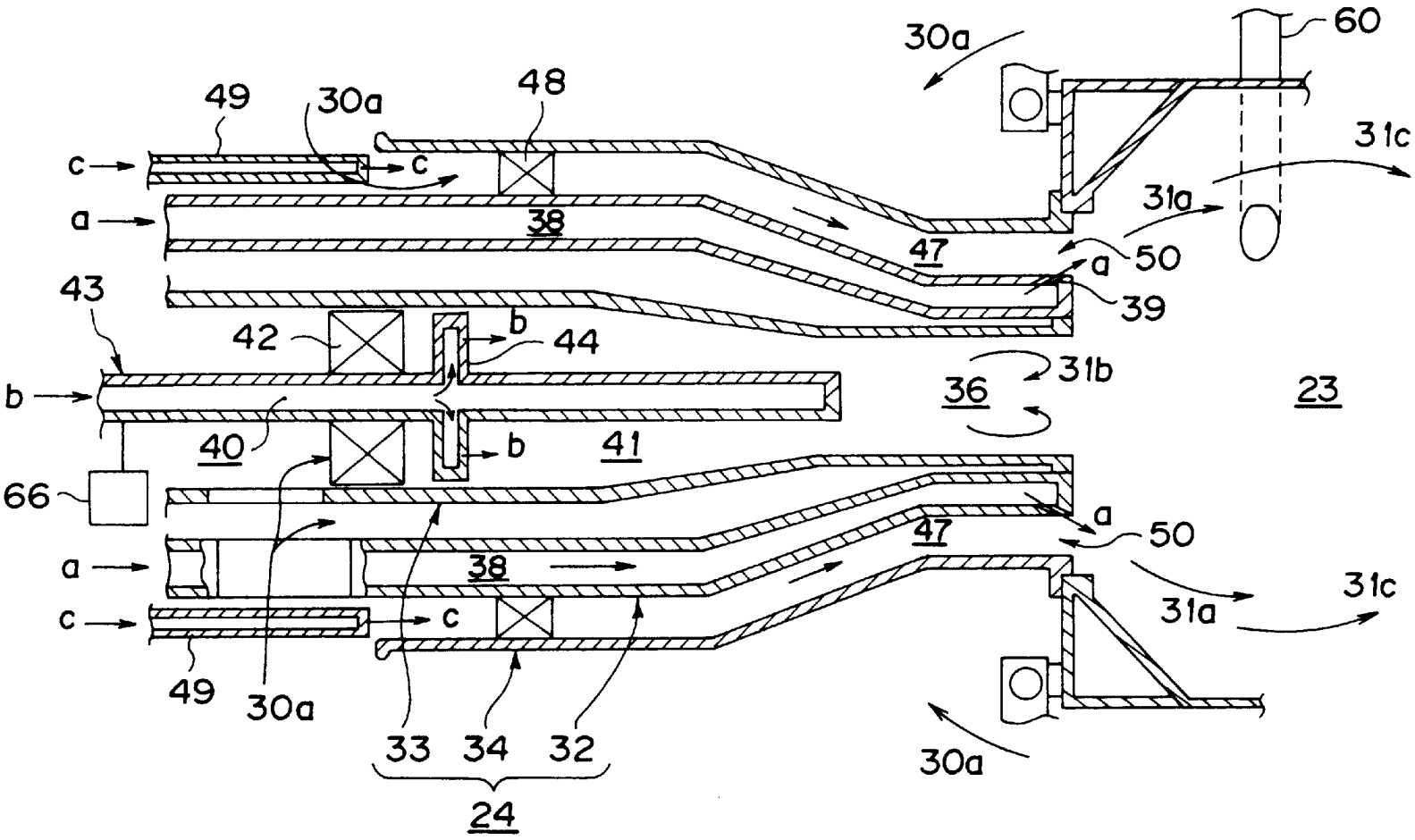
FIG. 15 is a schematic sectional view partly showing a sixth example of a gas turbine combustor according to the above embodiments.

FIG. 15 is a partial schematic sectional view showing a sixth example for carrying out the first embodiment, second embodiment or third embodiment of the gas turbine combustor according to the present invention.

This sixth example is provided with a drive unit 66 such as, for example, a motor, a hydraulic mechanism, a manual handle or the like to move the first fuel nozzle 43 of the first premixing combustion nozzle unit 33 so as to permit it to freely advance and retract as in the first, second or third embodiment. Further, the same components as those of the respective embodiments are denoted by the same reference numerals.

Since in this example, the drive unit 66 is disposed to the first fuel nozzle 43, the volume of the premixing combustion chamber 36 can be adjusted so as to be expanded or narrowed by advancing or retracting the first fuel nozzle 43 in the axial direction by the drive force of the drive unit 66.

The fuel b, which is injected from the first premixing fuel passage 40 of the first fuel nozzle 43 into the first premixing premixed gas passage 41 through the premixed fuel injection unit 44, is premixed with the compressed air 30*a* by the addition thereof, and the first premixed flame 31*b* is created in the premixing combustion chamber 36 by using the premixed gas. In this case, the flow rate of the fuel b varies depending upon the fact whether the gas turbine is in the start-up operation, in the partial load operation or the rated load operation, and there may be caused the vibration due to the combustion when the first premixed flame 31*b* is created at the transient time of the increase or decrease of the flow rate. It is known that since the frequency of the vibration due to the combustion often relates to the air/column vibration frequency of the combustion chamber, the vibration due to the combustion can be suppressed by changing the air/column vibration frequency of the combustion chamber when the flow rate of the fuel b is increased or decreased.

Thus, according to this example, the first premixed flame 31*b* is stably burnt by adjusting the volume of the premixing combustion chamber 36 so as to be expanded or narrowed by the advance or retraction of the first fuel nozzle 43 in the axial direction which is effected by the drive force of the drive unit 66.

Therefore, since the volume of the premixing combustion chamber 36 can be adjusted so that it is expanded or narrowed in this example, the occurrence of the vibration due to combustion can be suppressed.

Figure 16:
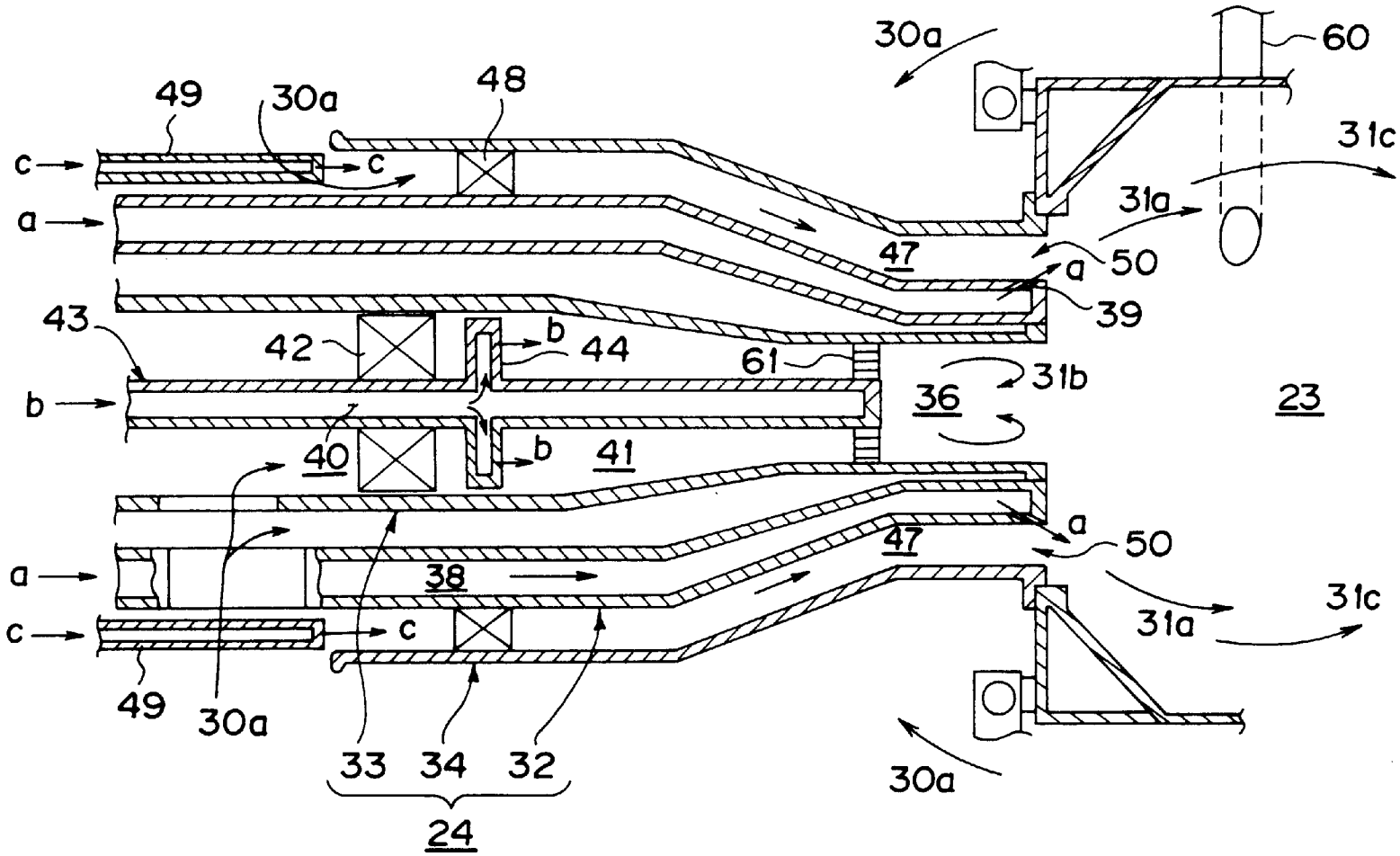
FIG. 16 is a schematic sectional view partly showing a seventh example of a gas turbine combustor according to the above embodiments.

FIG. 16 is a partial schematic sectional view showing a seventh example for carrying out the first embodiment, second embodiment or third embodiment of the gas turbine combustor according to the present invention.

In this seventh example, a catalyst 61 is disposed to the outlet of the first premixing premixed gas passage 41 of the first premixing combustion nozzle unit 33 in the first, second or third embodiment. Further, the same components as those of the respective embodiments are denoted by the same reference numerals.

In this example, since the catalyst 61 is disposed to the outlet of the first premixing premixed gas passage 41, when the first premixed flame 31*b* is created, the combustible limit value of the premixed gas based on the fuel b and the limit value at which no CO is generated can be lowered, and the concentration of the generated NOx can be suppressed to a low level.

Next, a method of operating the gas turbine combustor according to the present invention will be described.

The gas turbine combustor 20 controls the fuel to be supplied in accordance with respective operating states.

Figure 17:
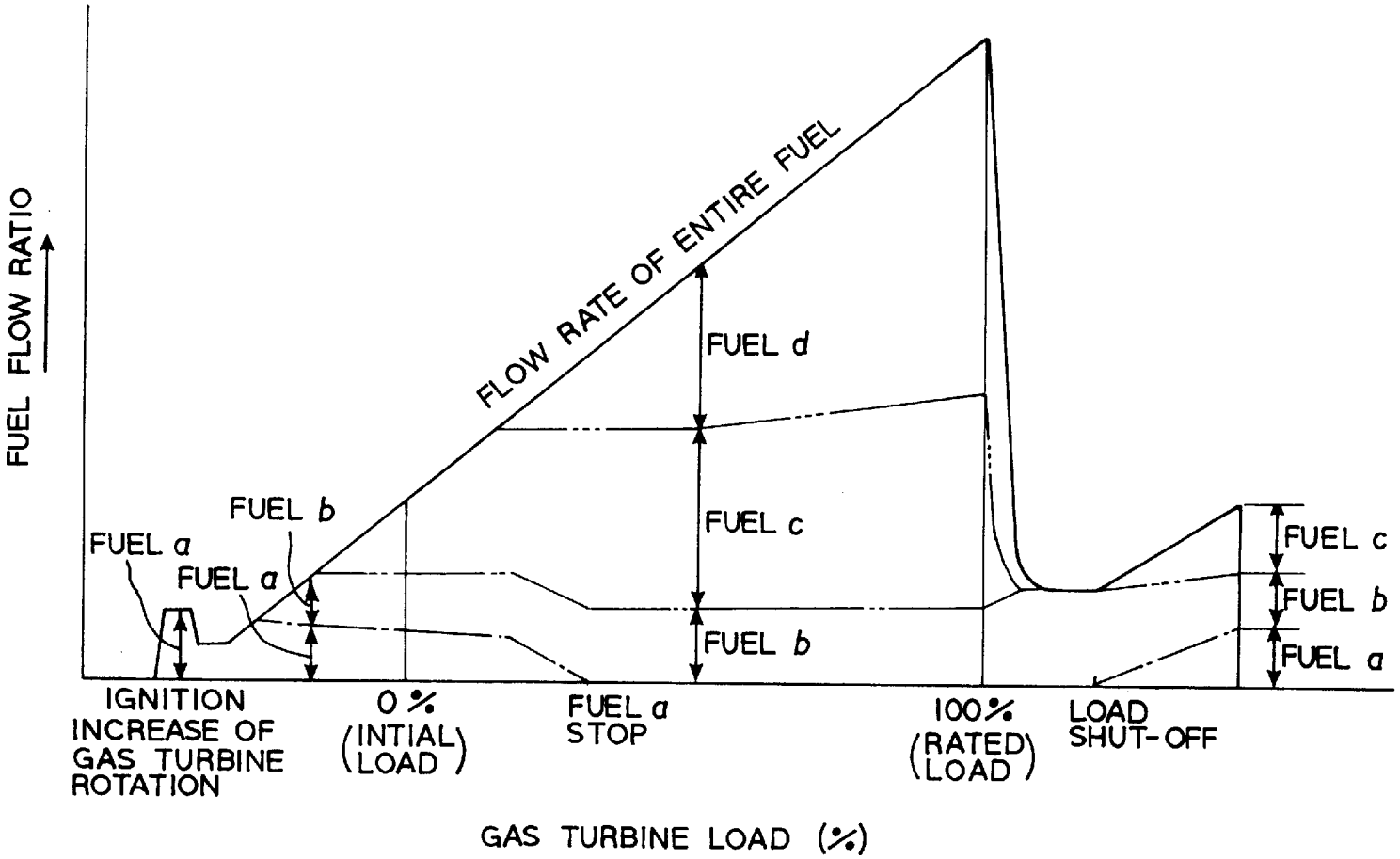
FIG. 17 is a view describing charge and distribution of a fuel in an operating method of a gas turbine combustor according to the present invention.

During the start-up operation of the gas turbine from the ignition of the fuel to the initial load thereof, the gas turbine combustor 20 first supplies the fuel a only to the diffusing combustion fuel passage 38 of the diffusing combustion nozzle unit 32 and creates the diffused flame 31*a* as shown in FIG. 17.

When the diffused flame 31*a* is stabilized, the gas turbine combustor 20 supplies the fuel b to the first premixing fuel passage 40 of the first fuel nozzle 43 in the first premixing combustion nozzle unit 33 and creates the first premixed flame 31*b*. Further, the fuel a is restricted simultaneously with the charge of the fuel b.

Next, the operation of the gas turbine is shifted from the initial load operation to the intermediate load operation, the gas turbine combustor 20 shuts off the supply of the fuel a into the diffusing combustion nozzle unit 32, supplies the fuel c into the second premixing combustion nozzle unit 34 and creates the second premixed flame 31*c*.

Further, when the load on the gas turbine increases, the gas turbine combustor 20 supplies the fuel d into the main premixing fuel injection unit 51 and creates the third premixed flame 31*d*.

As described above, the operating method of the gas turbine combustor 20 is such that the gas turbine is driven by using, as the combustion gas 31, the total mount of the first premixed flame 31*b* created from the first premixing combustion nozzle unit 33, the second premixed flame 31*c* created from the second premixing combustion nozzle unit 34 and the third premixed flame 31*d* created from the main premixing fuel injection unit 51 and then causes the gas turbine to reach the rated load. In the gas turbine combustor 20 which is not provided with the main premixing fuel injection unit 51, the first premixed flame 31*b* and the second premixed flame 31*c* cause the gas turbine to reach the rated load.

When a load shut-off command is issued because of, for example, an occurrence of an accident in a power system while the gas turbine is operated in the rated load, the gas turbine enters the no load operation. However, the gas turbine may exceed a rated rotation by inertia at the transient time of the load shut-off command. Thus, the gas turbine combustor 20 restricts the flow rate of the fuels supplied in the rated load up to 10% at the lowest. In this case, the gas turbine combustor 20 controls the distribution of the fuels to the respective nozzles units in such a manner that it shuts off the supply of the fuel d to the main premixing fuel injection unit 51 and the supply of the fuel c to the second premixing combustion nozzle unit 34, respectively, and continues the supply of the fuel b to the first premixing combustion nozzle unit 33 to thereby secure the first premixed flame 31*b* as shown in FIG. 17.

When the power system is restored and the gas turbine is restarted, the gas turbine combustor 20 generates the load of the gas turbine by sequentially adding the diffused flame 31*a* which is created by supplying the fuel a to the diffusing combustion nozzle unit 32 and the second premixed flame 31*c* which is created by supplying the fuel c to the second premixing combustion nozzle unit 34 to the first premixed flame 31*b* which has been continuously secured up to that time.

As described above, according to the operating method of the gas turbine combustor of the present invention, the first premixed flame 31*b* can be continuously secured at all times even if the gas turbine is operated without the load in response to the load shut-off command, the gas turbine can be set up to the rated load more promptly than a conventional method by shortening the restarting operation time thereof.

What is claimed is:

1. A gas turbine combustor comprising:

an outer casing;

a combustor inner cylinder disposed inside the outer casing;

a combustion chamber including a head side portion formed in the combustor inner cylinder;

at least one pilot fuel injection unit disposed to the head side portion of the combustion chamber, said pilot fuel injection unit comprising a first premixing combustion nozzle unit, a diffusing combustion nozzle unit and a second premixing combustion nozzle unit, said first premixing combustion nozzle unit being arranged at a central portion of said head side portion of the combustion chamber, said diffusing combustion nozzle unit being arranged so as to coaxially surround an outside of said first premixing combustion nozzle unit and said second premixing combustion nozzle unit being arranged so as to coaxially surround an outside of said diffusing combustion nozzle unit, respectively; and a premixing combustion chamber is disposed to an outlet side of said first premixing combustion nozzle unit so as to be communicated with said combustion chamber.

2. A gas turbine combustor according to claim 1, further comprising a main premixing fuel injection unit disposed to an outside of said second premixing combustion nozzle unit.

3. A gas turbine combustor according to claim 1, wherein at least two sets of the pilot fuel injection units are disposed to the head side portion of the combustion chamber, each of said pilot fuel injection units being composed of the first premixing combustion nozzle unit, the diffusing combustion nozzle unit and the second premixing combustion nozzle unit and being provided with the premixing combustion chamber disposed to the outlet side of said first premixing combustion nozzle unit.

4. A gas turbine combustor according to claim 1, wherein said premixing combustion chamber disposed to the outlet side of said first premixing combustion nozzle unit is formed to provide a conical shape.

5. A gas turbine combustor according to claim 4, wherein said premixing combustion chamber has a step-shaped cutout.

6. A gas turbine combustor according to claim 4, wherein said premixing combustion chamber has injection holes communicated with a compressed air passage surrounding the premixing combustion chamber.

7. A gas turbine combustor according to claim 4, wherein said premixing combustion chamber has a wall surface which is composed of either one of ceramics and a ceramic-fiber-reinforced composite material.

8. A gas turbine combustor according to claim 7, wherein said premixing combustion chamber has projecting pieces formed integrally with the wall surface.

9. A gas turbine combustor according to claim 4, wherein said premixing combustion chamber is provided with catalyst means.

10. A gas turbine combustor according to claim 1, wherein said diffusing combustion nozzle unit coaxially surrounding the outside of said first premixing combustion nozzle unit has a fuel injection hole arranged in a direction facing a flame propagation pipe disposed in the combustion chamber.

11. A gas turbine combustor according to claim 1, wherein said first premixing combustion nozzle unit has a drive unit for moving a first fuel nozzle accommodated in a first premixing premixed gas passage formed to surround the first premixing combustion nozzle so as to be freely advanced and retracted in an axial direction thereof.

12. A gas turbine combustor according to claim 11, wherein said drive unit is either one of a motor, a manual handle and a hydraulic mechanism.

13. A gas turbine combustor according to claim 1, wherein said premixing combustion chamber disposed to the outlet side of said first premixing combustion nozzle unit is formed to provide a concave shape.

14. A gas turbine combustor according to claim 13, wherein said premixing combustion chamber has a step-shaped cutout.

15. A gas turbine combustor according to claim 13, wherein said premixing combustion chamber has injection holes communicated with a compressed air passage surrounding the premixing combustion chamber.

16. A gas turbine combustor according to claim 13, wherein said premixing combustion chamber has a wall surface which is composed of either one of ceramics and a ceramic-fiber-reinforced composite material.

17. A gas turbine combustor according to claim 16, wherein said premixing combustion chamber has projecting pieces formed integrally with the wall surface.

18. A gas turbine combustor according to claim 13, wherein said premixing combustion chamber is provided with catalyst means.

* * * * *